US006914585B2

(12) United States Patent
Sakita

(10) Patent No.: US 6,914,585 B2
(45) Date of Patent: Jul. 5, 2005

(54) METHOD FOR DRIVING THREE-ELECTRODE SURFACE DISCHARGE AC TYPE PLASMA DISPLAY PANEL

(75) Inventor: Koichi Sakita, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 339 days.

(21) Appl. No.: 10/345,337

(22) Filed: Jan. 16, 2003

(65) Prior Publication Data

US 2003/0160742 A1 Aug. 28, 2003

(30) Foreign Application Priority Data

Feb. 26, 2002 (JP) ..... 2002-049047

(51) Int. Cl.[7] ..... G09G 3/28
(52) U.S. Cl. ..... 345/67; 345/60; 315/169.4
(58) Field of Search ..... 345/60–72; 315/169.1, 315/169.4; G09G 3/28

(56) References Cited

U.S. PATENT DOCUMENTS

| | | | | |
|---|---|---|---|---|
| 5,745,086 A | * | 4/1998 | Weber | 345/63 |
| 6,023,258 A | | 2/2000 | Kuriyama et al. | |
| 6,249,087 B1 | * | 6/2001 | Takayama et al. | 315/169.1 |
| 6,803,888 B1 | * | 10/2004 | Nakamura et al. | 345/60 |
| 2001/0017605 A1 | | 8/2001 | Hashimoto et al. | |
| 2001/0019246 A1 | | 9/2001 | Sakita et al. | |

FOREIGN PATENT DOCUMENTS

| | | |
|---|---|---|
| EP | 1 065 646 | 1/2001 |
| JP | 2000-259120 | 9/2000 |
| JP | 2002-351383 | 12/2002 |

OTHER PUBLICATIONS

"The Addressing Characteristics of an Alternating Current Plasma Display Panel Adopting a Ramping Reset Pulse", Kim J.K. et al., IEEE Transactions on Electron Devices, IEEE Inc. New York, pp. 1556–1563, 2001 (XP–001081083).

* cited by examiner

*Primary Examiner*—Alexander Eisen
(74) *Attorney, Agent, or Firm*—Staas & Halsey LLP

(57) ABSTRACT

A method for driving a plasma display panel is provided in which initialization is performed securely and the background light emission is reduced. As an operation for the initialization, an obtuse waveform pulse is applied to all cells three times. In the first obtuse waveform pulse application, discharge is generated only in the previously lighted cell, so that the wall voltage thereof approaches the wall voltage in the previously unlighted cell. In the second obtuse waveform pulse application, discharge is generated in the previously lighted cell and in the previously unlighted cell, so that the wall voltage in these cells changes to a value within an appropriate range. In the third obtuse waveform pulse application, discharge is generated in the previously lighted cell and in the previously unlighted cell, so that the wall voltage of these cells changes to a preset value.

6 Claims, 21 Drawing Sheets

METHOD FOR DRIVING THREE-ELECTRODE SURFACE DISCHARGE AC TYPE PLASMA DISPLAY PANEL

BACKGROUND OF THE INVENTION

1. Field of the Invention

The present invention relates to a method for driving a plasma display panel (PDP), and it is suitable for a surface discharge type and an AC type PDP. The surface discharge type means a structure in which display electrodes to be an anode and a cathode during display discharge for securing a luminance level (first electrodes and second electrodes) are arranged in parallel on a front or a back substrate. One of challenges for the AC type PDP is background light emission that is light emission in areas to be not lighted within a screen.

2. Description of the Prior Art

FIG. 1 shows a cell structure of a typical surface discharge type PDP. The PDP 1 comprises a pair of substrate structures (including a substrate and cell elements disposed on the substrate). The front substrate structure includes a glass substrate 11 and plural sets of display electrodes X and Y arranged on the inner surface of the glass substrate 11 in such a way that a set of display electrodes X and Y corresponds to a row of a matrix display. Each of the display electrodes X and Y includes a transparent conductive film 41 that forms a surface discharge gap and a metal film 42 overlaid on the edge portion of the transparent conductive film 41, and each of the display electrodes X and Y is coated with a dielectric layer 17 made of a low melting point glass and a protection film 18 made of magnesia. The back substrate structure includes a glass substrate 21 and address electrodes A arranged on the inner surface of the glass substrate 21 in such a way that an address electrode A corresponds to a column. The address electrode A is covered with a dielectric layer 24, on which a partition 29 is disposed for dividing a discharge space into columns. The upper face of the dielectric layer 24 and side faces of the partition 29 are covered with fluorescent material layers 28R, 28G and 28B for a color display. Italic letters (R, G and B) in FIG. 1 represent light emission colors of the fluorescent materials. The color arrangement has a pattern in which cells in a column has the same color and red, green and blue colors are repeated in turn. The fluorescent material layers 28R, 28G and 28B emit light when being excited locally by ultraviolet rays emitted by discharge gas. A structure of one column in one row corresponds to a cell, and three cells constitute one pixel of a display image. Since the cell is a binary light emission element, integral light emission quantity of each cell of each frame has to be controlled for displaying a color image.

FIG. 2 shows an example of a frame split for a color display. The color display is one type of gradation displays, and a display color is defined by combining luminance values of red, green and blue colors. The gradation display utilizes a method in which one frame includes plural subframes each of which has a luminance weight. As shown in FIG. 2, one frame includes eight subframes (SF denotes subframe in FIG. 2). The ratio of integral light emission quantities, i.e., the ratio of luminance weights of these subframes is set to 1:2:4:8:16:32:64:128 or approximate values, so that $2^8$(=256) gradation levels can be reproduced. For example, in order to reproduce gradation level 10, cells are lighted between subframe 2 having weight 2 and subframe 4 having weight 8 and are not lighted in other subframes.

An initialization period, an address period and a sustaining period are assigned to each subframe. An initialization process is performed in the initialization period for equalizing wall voltage of all cells, and an addressing process is performed in the address period for controlling wall voltage of each cell in accordance with display data. In addition, a sustaining process is performed in the sustaining period for generating display discharge only in cells to be lighted. One frame is displayed by repeating the initialization, addressing and sustaining processes. However, each subframe usually has a unique addressing process. In addition, periods of the sustaining processes are different depending on the luminance weight. Furthermore, the initialization process can be performed not in every subframe but only in a specific subframe (e.g., in the first subframe) so that background luminance is reduced and contrast is improved.

FIG. 3 shows the conventional drive waveforms. A common waveform is applied to the address electrodes A as many as columns of the screen except the address period, while a common waveform is applied to the display electrodes X as many as the number n of rows in every period. In FIG. 3, the waveforms for the address electrode A and the display electrode X are shown by the gross. In addition, the display electrodes Y as many as the number n of rows are used as a scan electrode for selecting a row in the address period. Therefore, a common waveform is applied to these display electrodes Y except the address period in the same way as the address electrode A. FIG. 3 shows waveforms for the display electrode Y(1) of the first row and the display electrode Y(n) of the last row as representatives.

The conventional operation in the initialization period includes two stages. In the first stage, an ascending obtuse waveform pulse is applied to display electrodes Y. Obtuse waveform is a generic term used to refer to pulse waveforms having a gentle leading edge. Namely, the operation in the first stage is a bias control for increasing potential of the display electrode Y simply. On this occasion, in order to shorten the time until reaching a predetermined potential, a positive offset bias is given to the display electrode Y, and a negative offset bias is given to the display electrode X. Then in the second stage, a descending obtuse waveform pulse is applied to the display electrode Y. Namely, the bias control is performed for dropping the potential of the display electrode Y simply. In the address period, a scan pulse is applied to the display electrodes Y one by one for the row selection. In synchronization with the row selection, an address pulse is applied to the address electrodes A corresponding to cells to be lighted in the selected row. Thus, address discharge is generated and a predetermined quantity of wall charge is formed in cells to be lighted. In the sustaining period, a positive sustain pulse is applied to the display electrode Y and the display electrode X alternately. At each application, display discharge is generated between display electrodes (hereinafter referred to as an XY-interelectrode) of the cell to be lighted.

At the start time of the initialization period, i.e., at the end of the sustaining period of the preceding subframe, there are cells with relatively much wall charge remained and cells with little wall charge. A cell that was lighted correctly in the previous subframe (hereinafter referred to as a previously lighted cell) has much wall charge remained, while a cell that maintained unlighted state correctly in the previous subframe (hereinafter referred to as a previously unlighted cell) has little wall charge remained. Here, "correctly" means faithfully to display data. If the addressing process is performed in the state where the charge quantity is different between cells as mentioned above, an error is apt to occur in which address discharge is generated in a cell that is not to be lighted. The initialization is important as a preparation for enhancing reliability of the addressing.

FIG. 4 is a diagram for explaining a principle of the conventional initialization. The initialization that is explained below is an operation for equalizing wall voltage between the previously lighted cell and the previously unlighted cell and for controlling it to be a set value suitable for the addressing. As an initialization waveform, a waveform that is a combination of a positive obtuse waveform and a negative obtuse waveform is used. In order to explain the principle simply, an initialization operation limited between two electrodes α and β will be explained. The voltage that is applied to the αβ-interelectrode (i.e., between the electrode α and the electrode β) is the potential difference between the electrode α and the electrode β. In other words, it is a relative value of the potential of the electrode β to the potential of the electrode α. The above-mentioned waveform of the initialization portion shown in FIG. 3 becomes the same waveform as in FIG. 4 when taking the display electrode Y as a reference and noting the operation of either the XY-interelectrode or the AY-interelectrode.

First a descending obtuse waveform pulse having the amplitude Vr1 is applied to the αβ-interelectrode, and then an ascending obtuse waveform pulse having the amplitude Vr2 is applied to the same. The solid line indicates a variation of the voltage that is applied to the interelectrode, while the broken line and the dotted line indicate variations of the cell charge quantity (wall voltage). However, it should be noted that the wall voltage is plotted after reversing positive and negative signs. The action of applying the obtuse waveform pulse is deeply related to the cell state when the previous subframe is finished. The wall voltage when the cell was lighted in the previous subframe (hereinafter referred to as the wall voltage in the previously lighted cell) is shown in the broken line, while the wall voltage when the cell was not lighted in the previous subframe (hereinafter referred to as the wall voltage in the previously unlighted cell) is shown in the dotted line.

In the AC type PDP, since a voltage component due to electrification is added to the applied voltage component, the effective voltage that is applied to the discharge space (hereinafter referred to a cell voltage) becomes as follows.

$$\text{(cell voltage)}=\text{(applied voltage)}+\text{(wall voltage)}$$

Since the sign of the wall voltage is reversed, the level of the cell voltage at any time is indicated by the distance between the dotted line (or the broken line) and the solid line in FIG. 4. If the solid line is under the broken line (or the dotted line), the cell voltage is negative. If the solid line is above the broken line (or the dotted line), the cell voltage is positive. Therefore, the cell voltage is negative while the negative obtuse waveform pulse is applied in the first half, and the cell voltage is positive while the positive obtuse waveform pulse is applied in the second half, as shown in FIG. 4.

At the time t0 before starting the initialization, the wall voltage is negative both in the previously lighted cell and the previously unlighted cell (Since the sign is reversed, the dotted line and the broken line above the line indicating zero volt represent negative wall voltage). As illustrated, the negative wall voltage is higher in the previously lighted cell. As the negative voltage that is applied to the cells in this state is increasing gradually, the cell voltage increases. Since the previously lighted cell becomes more negatively charged, discharge starts at the time t1 in the previously lighted cell earlier than in the previously unlighted cell. Once the discharge starts, electrification of the wall charge occurs so that the cell voltage is kept at the discharge start threshold level −Vt1 in the case where the electrode α is a cathode, and wall voltage corresponding to the electrification quantity is generated (hereinafter this phenomenon is expressed as "wall voltage is written"). Discharge starts in the previously unlighted cell at the time t2 that is a short time after the start of discharge in the previously lighted cell. Once the discharge starts, wall voltage is written so that the cell voltage is kept at the threshold level −Vt1 in the previously unlighted cell, too. The application of the descending obtuse waveform pulse is finished at the time t3. At this time point, the wall voltage has the value of −Vr1+Vt1 in the previously lighted cell as well as in the previously unlighted cell.

Next, the polarity of the applied voltage is reversed, and the positive obtuse waveform pulse is applied to the αβ-interelectrode. Since the wall voltage in the previously lighted cell is made the same value as the wall voltage in the previously unlighted cell by the above-mentioned application of negative obtuse waveform pulse, discharge starts at the same time t4 in both cells. The discharge continues till the end of the positive obtuse waveform while changing the wall voltage. The cell voltage is maintained at the discharge start threshold level Vt2 in the case where the electrode α is an anode. The wall voltage is Vr2−Vt2 at the time t5 when the discharge finished. Since the threshold level Vt2 is a constant unique to the discharge between the electrodes α and β, the wall voltage after the application of the positive obtuse waveform pulse is finished depends on the amplitude Vr2 of a predetermined applied voltage.

For improving contrast of a display, it is effective to reduce light emission in the initialization, especially light emission in the previously unlighted cell. Either in a static image or in a moving image, noting a cell for displaying a black color or a dark color within a screen, the condition often occurs where the cell becomes the previously unlighted cell from a certain subframe to the following one or more subframes. Namely, supposing that in the initialization of the noted subframe the noted cell is a cell not to be lighted (unlighted cell) that is affected by the light emission in the initialization more easily than the cell to be lighted, the cell is likely to be the previously unlighted cell. Therefore, if the light emission in the previously unlighted cell is reduced, a contrast ratio can be increased. The contrast ratio is determined by total light emission quantity in the previously lighted cell and light quantity of undesirable light emission in the previously unlighted cell.

In order to secure the initialization, it is necessary to increase the amplitudes of the first and the second obtuse waveform pulse so that the written quantities of the positive and negative wall voltage are increased. However, the increase of the amplitude may increase the light quantity of the undesired light emission and may decrease the contrast ratio.

Conventionally, concerning the write quantity of the wall voltage in the previously unlighted cell, there is a problem that it is difficult to determine the optimum value that enables compatibility between performing initialization securely and reducing the background light emission. If the cell has only two electrodes, its operation is simple, so that the relationship between the applied voltage and the operation can be expected easily. In contrast, the cell has three electrodes in the practical plasma display panel, and the three electrodes influence each other resulting in a complicated operation. Therefore, the drive condition has to be optimized by trial and error. Difficulties in optimizing the write quantity of the wall voltage will be explained in detail as follows.

FIG. 5 shows the appropriate initialization in the conventional method. FIG. 6 shows the inappropriate initialization in the conventional method. In a three-electrode structure PDP, the relationship among three electrodes becomes known if two of three electrodes are analyzed. Since an actual driving process controls mainly the discharge at the XY-interelectrode and the AY-interelectrode, it is preferable to perform the analysis noting voltages at the XY interelectrode and the AY-interelectrode.

Though the applied voltage waveforms shown in FIGS. 5 and 6 do not seem to correspond to waveforms shown in FIG. 3 at first glance, they substantially correspond to one another. Even if the ascending or descending obtuse waveform pulse is applied only to the display electrode Y as shown in FIG. 3, the voltage waveform at the XY-interelectrode in the initialization period is similar to the waveform shown in FIGS. 5 and 6. In FIGS. 5 and 6, the solid line shows a variation of the applied voltage, the broken line shows a variation of the wall voltage in the previously lighted cell, and the dotted line shows a variation of the wall voltage in the previously unlighted cell. Since the wall voltage is plotted after positive and negative signs are reversed similarly to FIG. 4, the distance between the solid line and the broken line or the dotted line can be read as the cell voltage between corresponding electrodes in FIGS. 5 and 6, too.

In the discharge due to application of the obtuse waveform pulse, the discharge start threshold level is an important parameter. Therefore, the discharge start threshold level in the three-electrode structure is defined as follows.

$Vt_{XY}$: discharge start threshold level at the XY-interelectrode when the cell voltage at the XY-interelectrode is positive $Vt_{YX}$: discharge start threshold level at the XY-interelectrode when the cell voltage at the XY-interelectrode is negative $Vt_{AY}$: discharge start threshold level at the AY-interelectrode when the cell voltage at the AY-interelectrode is positive $Vt_{YA}$: discharge start threshold level at the AY-interelectrode when the cell voltage at the AY-interelectrode is negative $Vt_{AX}$: discharge start threshold level at the AX-interelectrode when the cell voltage at the AX-interelectrode is positive $Vt_{XA}$: discharge start threshold level at the AX-interelectrode when the cell voltage at the AX-interelectrode is negative As an example, the wall voltage at the XY-interelectrode just before the initialization is started (i.e., at the time t0) is negative in the previously lighted cell and positive in the previously unlighted cell, and the wall voltage at the AY-interelectrode is zero in the previously lighted cell and positive in the previously unlighted cell (note that positive and negative signs of the wall voltage are reversed in FIGS. 5 and 6).

In FIG. 5, when both the applied voltages (negative) at the XY-interelectrode and the AY-interelectrode increase, the cell voltage in the previously lighted cell reaches the threshold level at the time t1 first, and discharge at the XY-interelectrode starts in the previously lighted cell (hereinafter referred to as XY-discharge). This discharge lasts until the applied voltage reaches the negative peak value, so that the cell voltage at the XY-interelectrode is kept at $-Vt_{YX}$. Namely, the wall voltage changes in response to the variation of the applied voltage. The XY-discharge starts in the previously unlighted cell at the time t2 after the time t1. Also in the previously unlighted cell, similarly to the previously lighted cell, the discharge continues until the applied voltage reaches the negative peak value, so that the cell voltage at the XY-interelectrode is kept at $-Vt_{YX}$. Therefore, the wall voltage at the XY-interelectrode is $-Vt_{YX}$ in the previously lighted cell as well as in the previously unlighted cell at the time t3 when the application of the obtuse waveform pulse in the first stage finishes.

Noting the AY-interelectrode, both in the previously lighted cell and the previously unlighted cell, the wall voltage at the AY-interelectrode varies after the XY-discharge starts. However, this variation is not caused by the discharge at the AY-interelectrode (hereinafter referred to as AY-discharge) but is a relative change in accordance with the variation of the wall voltage at the XY-interelectrode. Therefore, the cell voltage at the AY-interelectrode is not maintained at the threshold level $-Vt_{YA}$ but continues to increase simply toward the negative side. If the amplitude of the first stage obtuse waveform pulse applied to the AY-interelectrode is not large enough, the discharge at the AY-interelectrode does not start either in the previously lighted cell or the previously unlighted cell. For this reason, at the time t3 when the first stage application of the obtuse waveform pulse is finished, the wall voltage at the AY-interelectrode in the previously lighted cell is different from that in the previously unlighted cell. The wall voltage of the previously lighted cell is larger than the wall voltage in the previously unlighted cell.

When the second stage application of the obtuse waveform pulse starts, the polarity of the applied voltage is reversed. First, the AY-discharge starts in the previously lighted cell at the time t4. During the discharge, the wall voltage at the AY-interelectrode changes so that the cell voltage in the previously lighted cell at the AY-interelectrode is kept at $Vt_{AY}$. Responding to this change, the cell voltage at the XY-interelectrode also changes. However, the change at the XY-interelectrode is a phenomenon that the wall voltage of the XY-interelectrode changes relatively by the discharge at the AY-interelectrode, and the wall voltage at the XY-interelectrode is not controlled directly. The direct control starts at the time t6 when the discharge at the XY-interelectrode starts.

In the previously unlighted cell, the XY-discharge starts at the time t5, and during the discharge the wall voltage of the XY-interelectrode changes so that the cell voltage at the XY-interelectrode is kept at $Vt_{XY}$. The wall voltage at the AY-interelectrode also changes. However, this is a phenomenon that is caused by the relative change of the wall voltage at the AY-interelectrode due to the XY-discharge and is not a phenomenon that is caused by a direct control of the wall voltage at the AY-interelectrode by the AY-discharge. The direct control starts at the time t7 when the discharge at the AY-interelectrode starts.

When the application of the obtuse waveform pulse in the second stage finishes, the wall voltage at the XY-interelectrode is $Vr_{XY}2-Vt_{XY}$, and the wall voltage at the AY-interelectrode is $Vr_{AY}2-Vt_{AY}$ both in the previously lighted cell and in the previously unlighted cell. Namely, the necessary condition for controlling the wall voltage at the XY-interelectrode and the wall voltage at the AY-interelectrode to a desired value is that discharge is generated both in the XY-interelectrode and in the AY-interelectrode by the second stage application of the obtuse waveform pulse, and that the discharge periods overlap each other in time scale. Hereinafter the phenomenon that discharge is generated at two interelectrodes (at two positions) at one time is referred to as "simultaneous discharge".

The action of the cell explained above is merely an example, and there are other examples. For example, the AY-discharge may be generated after the XY-discharge is generated in the previously lighted cell by the second stage application of the obtuse waveform pulse. In which interelectrode the discharge will be generated, the XY-interelectrode or the AY-interelectrode, depends on the state of the wall voltage just before the initialization and the set voltage of the first and the second obtuse waveform pulse. However, whichever discharge is generated first, the drive voltage has to be set so that the discharge is generated both at the XY-interelectrode and the AY-interelectrode simultaneously during the second stage application of the obtuse waveform pulse.

In FIG. 6, the light emission quantity in the previously unlighted cell is reduced by decreasing the amplitude of the first obtuse waveform pulse. However, the simultaneous discharge is not generated in the previously lighted cell during the second obtuse waveform pulse application. The wall voltage at the XY-interelectrode in the previously lighted cell when the second obtuse waveform pulse application is finished is not the target of the control. This may make the addressing of the previously lighted cell uncertain and may cause incorrect lighting or incorrect extinguish.

As explained above, it is very difficult to determine the lower limit of the wall voltage write quantity in the previously unlighted cell while controlling the complicated discharge in the three-electrode structure. Therefore, an adequate improvement of the darkroom contrast ratio in a PDP display has not been achieved. In addition, if only the improvement of the darkroom contrast ratio is regarded as important, the incorrect lighting will occur easily, resulting in significant display instability.

SUMMARY OF THE INVENTION

In a first aspect of the present invention, the following three operations are performed in turn as a preparation for the addressing. (1) Making electrification state of the previously lighted cell approach to electrification state of the previously unlighted cell. More specifically, the wall voltage point in the previously lighted cell on the cell voltage plane is moved to the vicinity of the line that passes the wall voltage point in the previously unlighted cell and has the gradient 1/2. (2) Generating discharge by the obtuse waveform pulse application in the previously lighted cell and in the previously unlighted cell, so that the wall voltage points of these cells on the cell voltage plane are within the simultaneous initialization fixed area. The simultaneous initialization fixed area means a conditional area in which simultaneous discharge can be generated securely by an appropriate obtuse waveform pulse application. (3) Generating simultaneous discharge by the obtuse waveform pulse application, so that wall voltages in the previously lighted cell and in the previously unlighted cell are aligned at a preset value. In this way, as a preprocess of the operation (2) the operation (1) is performed, thereby the amplitude of the obtuse waveform pulse for achieving the purpose of the operation (2) is reduced. If the amplitude of the obtuse waveform pulse is small, the written quantity of the wall voltage in the previously unlighted cell (i.e., light emission quantity) is little. Therefore, by performing the operations (1) and (2), luminance of the background light emission can be lower than in the conventional method.

In a second aspect of the present invention, the following three operations are performed in turn as a preparation for the addressing. (1) Making the wall voltage point in the previously lighted cell on the cell voltage plane approach the simultaneous initialization fixed area without entering the area by the obtuse waveform pulse application. (2) Generating discharge only in the previously lighted cell, so that the wall voltage point in the previously lighted cell enters the simultaneous initialization fixed area. (3) Generating simultaneous discharge by the obtuse waveform pulse application so as to align wall voltages in the previously lighted cell and in the previously unlighted cell to a preset value. The amplitude of the obtuse waveform pulse for achieving the purpose of the operation (1) among these operations is smaller than in the case where the wall voltage point is in the simultaneous initialization fixed area. If the amplitude of the obtuse waveform pulse is small, the written quantity of the wall voltage in the previously unlighted cell (i.e., the light emission quantity) is little. In the operation (2), the previously unlighted cell is not lighted. Therefore, by performing the operations (1) and (2), luminance of the background light emission can be lower than in the conventional method.

DESCRIPTION OF THE PREFERRED EMBODIMENTS

Hereinafter, the present invention will be explained more in detail with reference to embodiments and drawings.

[Analysis of Cell Operation]

Figure 1:
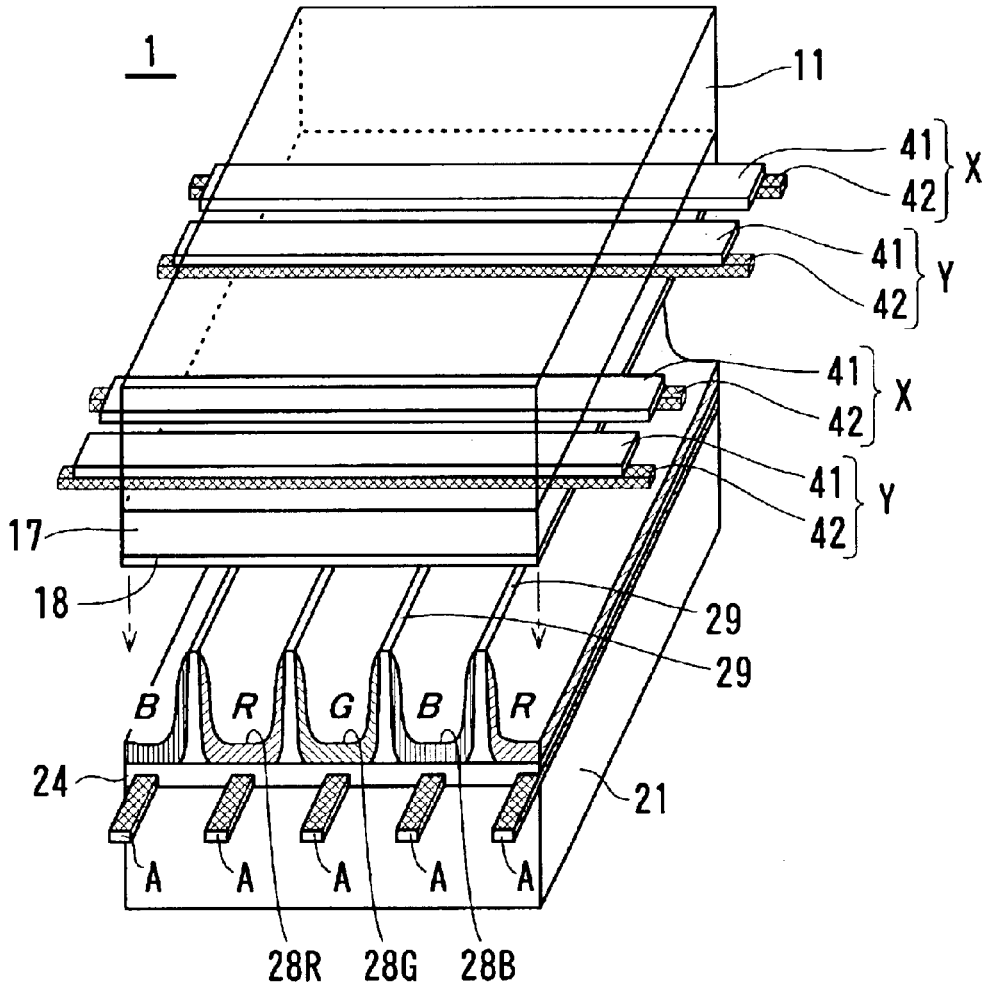
FIG. 1 PRIOR ART
FIG. 1 is a diagram showing a cell structure of a typical surface discharge type PDP.
Figure 2:
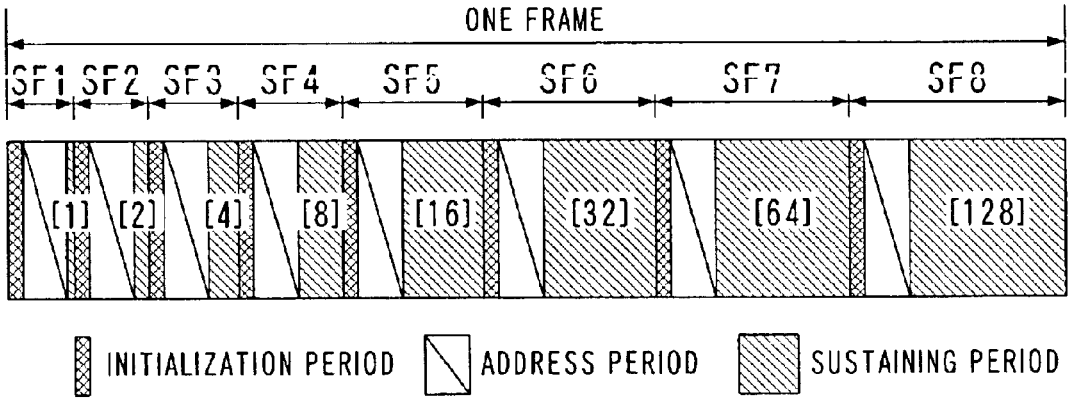
FIG. 2 PRIOR ART
FIG. 2 is a diagram showing an example of a frame split for a color display.

First, a method for analyzing addressing preparation process by obtuse waveform pulse application noting the state of the cell will be explained. As shown in FIG. 1, a discharge state of a cell having three electrodes, i.e., a first electrode (a display electrode X), a second electrode (a display electrode Y) and a third electrode (an address electrode A) can be described by cell voltage at the XY-interelectrode and cell voltage at the AY-interelectrode. Since the cell voltage between the address electrode A and the display electrode X (this is called an AX-interelectrode) can be shown as the difference between the cell voltage at the XY-interelectrode and the cell voltage at the AY-interelectrode, the state of the cell depends on the voltages at the XY-interelectrode and the AY-interelectrode. Other than this, the combinations of the cell voltages for describing the state of the cell includes the combination of the cell voltage at the AX-interelectrode and the cell voltage at the AY-interelectrode, and the combination of the cell voltage at the AX-interelectrode and the cell voltage at the XY-interelectrode. Any combination can be selected. However, since the display discharge is usually generated at the XY-interelectrode and the address discharge is generated at the AY-interelectrode, it is preferable to select the combination of the cell voltage at the XY-interelectrode and the cell voltage at the AY-interelectrode.

[Explanation of Cell Voltage Plane]

Figure 7:
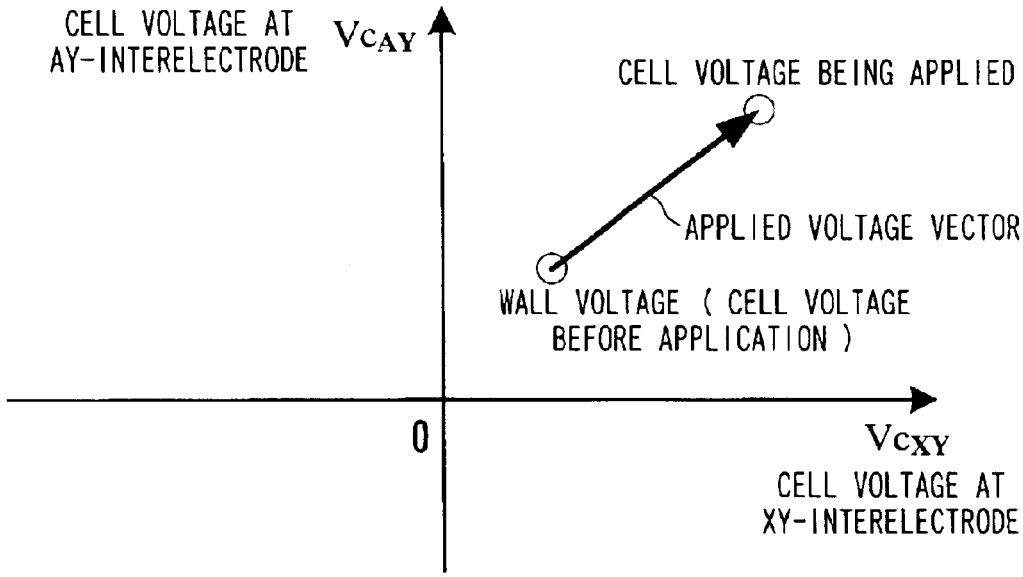
FIG. 7 is a explanatory diagram of the cell voltage plane.

A cell voltage plane is used for analyzing the operation of the three-electrode structure PDP. The cell voltage plane assumed here is a rectangular coordinates plane having a horizontal axis corresponding to the cell voltage $Vc_{XY}$ at the XY-interelectrode and a vertical axis corresponding to the cell voltage $Vc_{AY}$ at the AY-interelectrode as shown in FIG. 7. On the cell voltage plane, relationship among the cell voltage, the wall voltage and the applied voltage is shown geometrically with dots and arrows. A cell voltage point that is a point on the plane indicates a value of the cell voltage at the XY-interelectrode or the AY-interelectrode. The cell voltage when the applied voltage is zero is equal to the wall voltage. Therefore, the cell voltage point corresponding to this state is called a "wall voltage point". When a voltage is applied to the cell or the wall voltage varies, the cell voltage point moves by a distance corresponding to the applied voltage or a variation of the wall voltage. This movement is shown by an arrow as a two-dimensional vector.

[Explanation of Vt Closed Curve]

Figure 8:
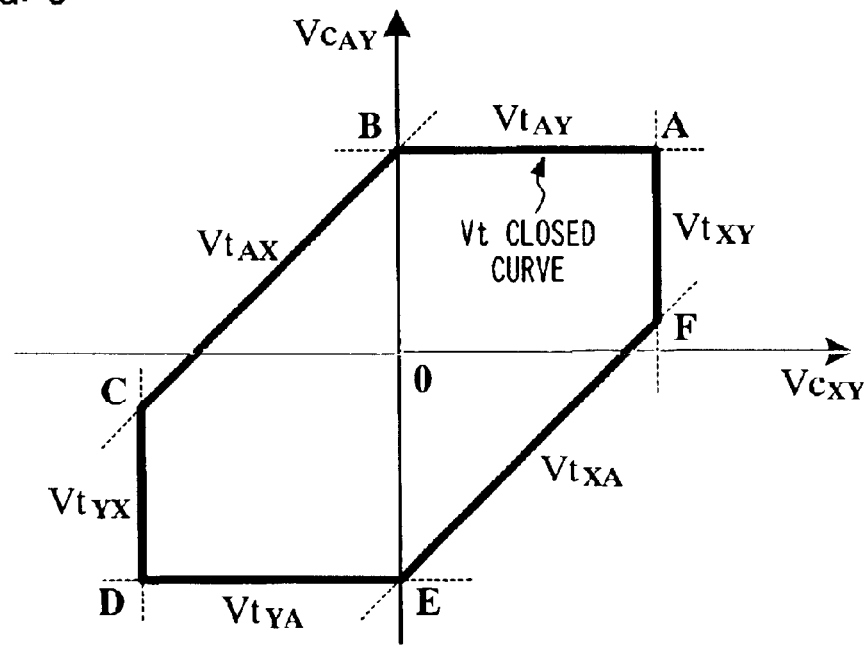
FIG. 8 is an explanatory diagram of Vt closed curve.

FIG. 8 is an explanatory diagram of Vt closed curve. In the initialization process, the above-defined discharge start threshold levels $Vt_{XY}$, $Vt_{YX}$, $Vt_{AY}$, $Vt_{YA}$, $Vt_{AX}$ and $Vt_{XA}$ are important. When plotting the discharge start threshold level points on the cell voltage plane, a hexagon appears. This hexagon is called a "Vt closed curve". The Vt closed curve indicates a voltage range in which discharge is generated. The cell voltage point in the state where discharge stops, i.e., the wall voltage point is always located inside the Vt closed curve. Each of the six sides AB, BC, CD, DE, EF and FA of the Vt closed curve shown in FIG. 8 corresponds to one interelectrode discharge as follows.

Side AB: AY-discharge when the display electrode Y is a cathode

Side BC: AX-discharge when the display electrode X is a cathode (discharge at the AX-interelectrode)

Side CD: XY-discharge when the display electrode X is a cathode

Side DE: AY-discharge when the address electrode A is a cathode

Side EF: AX-discharge when the address electrode A is a cathode

Side FA: XY-discharge when the display electrode Y is a cathode

Furthermore, each of the six apexes A, B, C, D, E and F is a point satisfying two discharge start threshold levels simultaneously (these are called "simultaneous discharge points") and corresponds to one of simultaneous discharges of the following combination.

Figure 9:
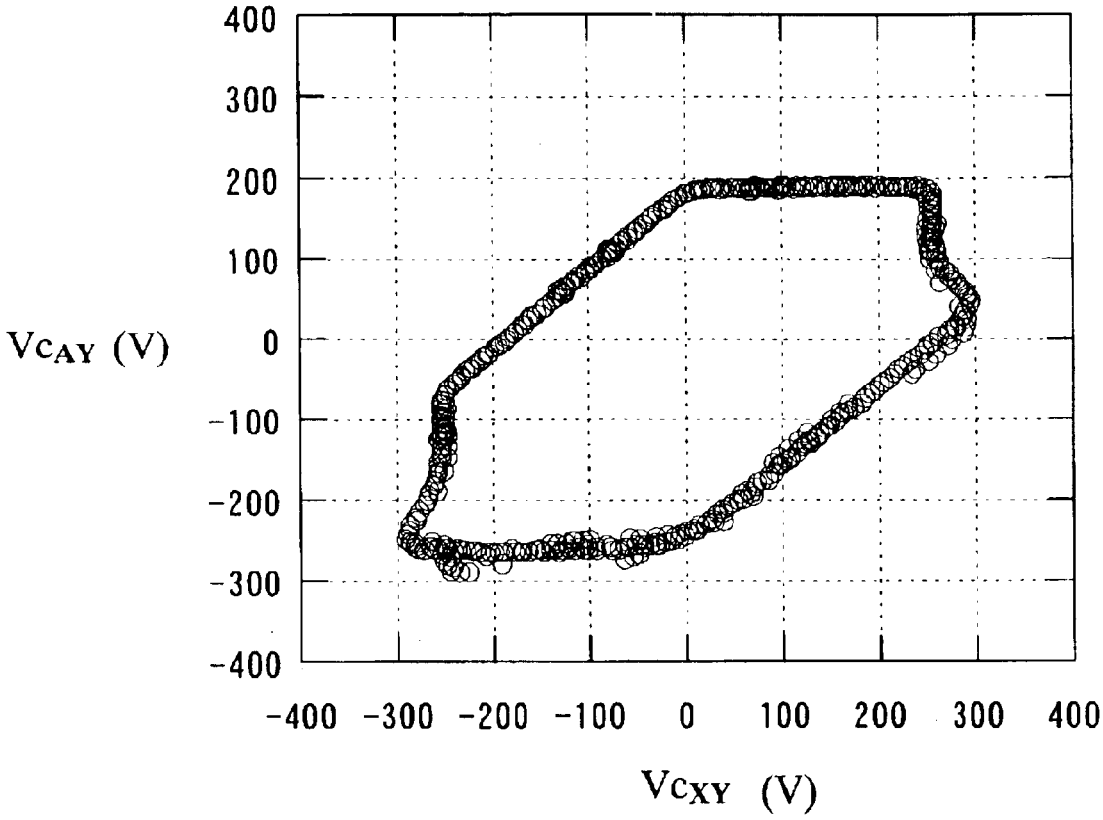
FIG. 9 is a diagram showing an example of the measured Vt closed curve.

Point A: simultaneous discharge at the XY-interelectrode and the AY-interelectrode when the display electrode Y is a common cathode Point B: simultaneous discharge at the AY-interelectrode and the AX-interelectrode when the address electrode A is a common anode Point C: simultaneous discharge at the AX-interelectrode and the XY-interelectrode when the display electrode X is a common cathode Point D: simultaneous discharge at the XY-interelectrode and the AY-interelectrode when the display electrode Y is a common anode Point E: simultaneous discharge at the AY-interelectrode and the AX-interelectrode when the address electrode A is a common cathode Point F: simultaneous discharge at the XA-interelectrode and the XY-interelectrode when the display electrode X is a common anode FIG. 9 is a diagram showing an example of the measured Vt closed curve. In FIG. 9, the portion relevant to the XY-discharge is not linear but has a little distortion, and the Vt closed curve has a figure similar to a hexagon. Hereinafter the Vt closed curve is regarded as a hexagon for explanation. Using the above-mentioned cell voltage plane and the Vt closed curve, the operation of the cell when obtuse waveform pulse is applied will be clarified.

[Analysis of Discharge at One Interelectrode]

Figure 10A:
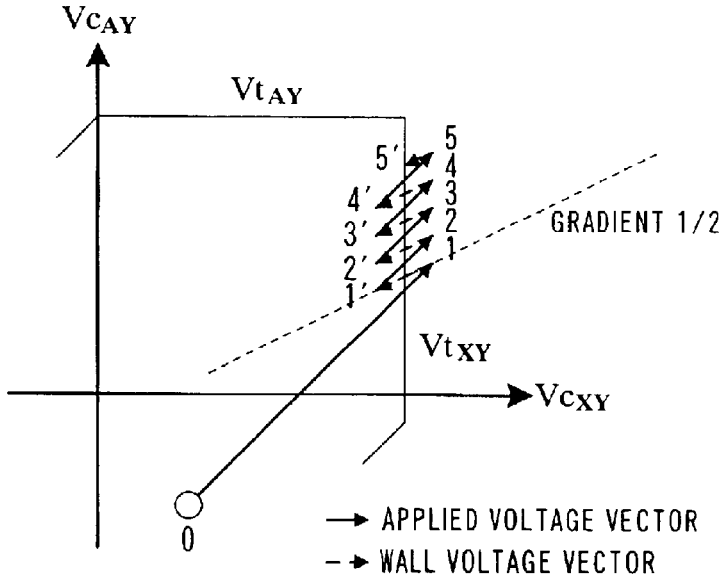
FIGS. 10A and 10B are explanatory diagrams of analysis of the XY-discharge due to the obtuse waveform pulse application.
Figure 10B:
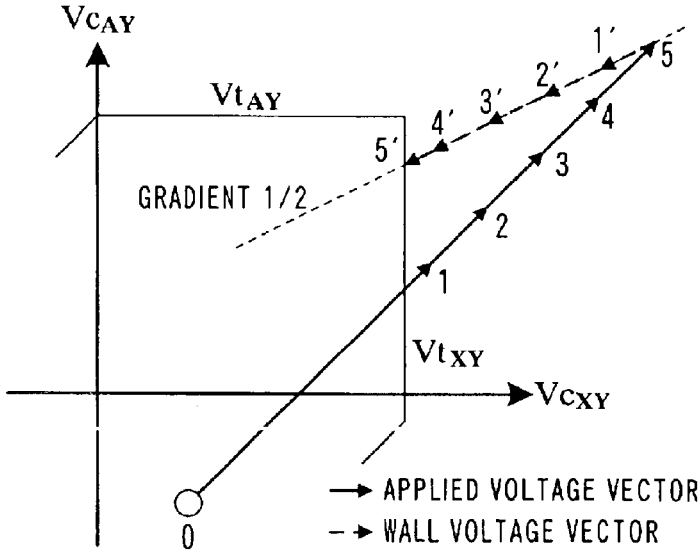

First, it is supposed that one of the XY-discharge, the AY-discharge and the AX-discharge (e.g., the XY-discharge) is generated by application of one obtuse waveform pulse. FIGS. 10A and 10B are explanatory diagrams of the analysis of the XY-discharge due to the obtuse waveform pulse application. In FIG. 10A, the point 0 is a cell voltage point just before the obtuse waveform pulse application. When the obtuse waveform pulse is applied, the cell voltage point moves from the point 0 to the point 1. When the cell voltage point passes crossing the Vt closed curve during the movement, the cell voltage at the XY-interelectrode exceeds the discharge start threshold level $Vt_{XY}$, so that the XY-discharge is generated. In the discharge due to the obtuse waveform pulse application, after the cell voltage exceeds the threshold level, the wall voltage is written so that the cell voltage is kept at the threshold level. This writing is shown by a wall voltage vector 11' (a starting point is the point 1 and an end point is the point 1'). Since the obtuse waveform pulse continues to increase until the voltage value reaches a peak, the increase that is the applied voltage vector 1'2 is added so that the cell voltage point moves from the point 1' to the point 2. The similar process is repeated until the voltage of the obtuse waveform pulse reaches a peak. Since the XY-discharge is generated, the charge moves mainly between the X electrode and the display electrode Y. Supposing that wall charge +Q moves to the X electrode and the wall charge −Q moves to the display electrode Y, it means that wall charge Q−(−Q)=2Q moves between the XY-interelectrode and wall charge −(−Q)=Q moves between the AY-interelectrode. Therefore, in the cell voltage plane having two axes as mentioned above, the direction of writing by the XY-discharge has the gradient 1/2. This gradient is not strictly the wall charge but should be derived from the wall voltage and depends on a figure or a material of the dielectric layer covering the electrode. However, since the actually measured value of the gradient is substantially 1/2, the gradient is approximated to 1/2 in the analysis.

The cell voltage point when one obtuse waveform pulse application is finished and the total sum of the wall voltage variation associated with the obtuse waveform pulse application can be determined geometrically as shown in FIG. 10B. The process is as follows. The applied voltage vectors are added one by one to the initial wall voltage point as the start point so that the total applied voltage vector 05 is drawn. A line that has the gradient 1/2 and passes through the end point 5 of the total applied voltage vector 05 is drawn. Then, the diagram is checked. The intersection 5' of the line having the gradient 1/2 and the Vt closed curve is the cell voltage point after the movement, and the distance from the point 5 to the point 5' is the total sum of the wall voltage variation. The vector 5' in FIG. 10B corresponds to the total sum of the wall voltage vector in FIG. 10A. It should be noted that the cell voltage actually is not be such a large value as the point 5 in FIG. 10B, and the cell voltage point passes the vicinity of the Vt closed curve as shown in FIG. 10A.

Figure 11:
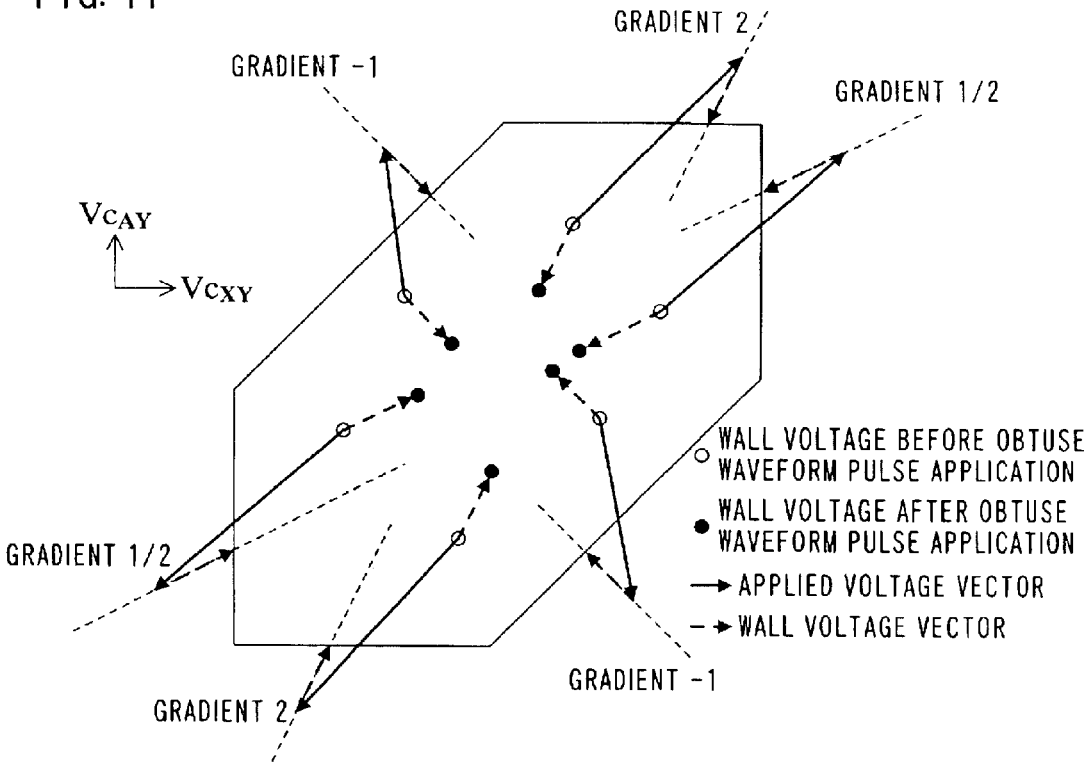
FIG. 11 shows directions in which wall voltage is written by the discharge due to the obtuse waveform pulse application.

Though the XY-discharge is taken as an example in FIGS. 10A and 10B, the AX-discharge and the AY-discharge can be analyzed similarly. FIG. 11 shows directions of wall voltage vectors that are written by three kinds of discharge. In FIG. 11, small circles represent wall voltage points when the obtuse waveform pulse application is started, solid lines with arrows represent applied voltage vectors, broken lines with arrows represent wall voltage vectors, and dots represent wall voltage points when the obtuse waveform pulse application is finished. The direction of the wall voltage vector has the gradient 1/2 in the XY-discharge, the gradient 2 in the AY-discharge, and the gradient −1 in the AX-discharge.

[Analysis of Simultaneous Discharge]

Figure 12:
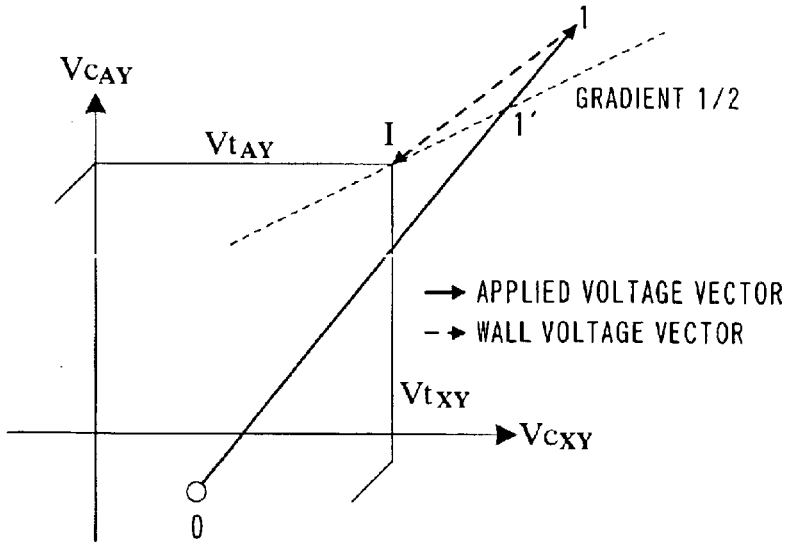
FIG. 12 is an explanatory diagram of analysis of the simultaneous discharge.

Next, the case is supposed where application of one obtuse waveform pulse causes two of the XY-discharge, the AY-discharge and the AX-discharge (e.g., the XY-discharge and the AY-discharge) simultaneously. FIG. 12 is an explanatory diagram of analysis of the simultaneous discharge. Here, the case will be explained where the XY-discharge is generated earlier than the AY-discharge, and after that the simultaneous discharge is generated. As shown in FIG. 12, a line that passes the simultaneous initialization point I of the XY-discharge and the AY-discharge and has the gradient 1/2 is drawn. Similarly to FIG. 10B, applied voltage vectors are added to the initial wall voltage point as a start point, so as to draw a total applied voltage vector 01. If the end point 1 of the total applied voltage vector 01 is below the line having the gradient 1/2, only the XY-discharge is generated. In this case, the method that was explained with reference to FIG. 10 can be used. The case where the point 1 is above the line having the gradient 1/2 is the case where the discharge is generated at the XY-interelectrode and at the AY-interelectrode simultaneously after the XY-discharge is generated. In this case, the movement from the point 1 to the simultaneous initialization point I is the wall voltage vector. In this case, the wall voltage is written so that the wall voltage vector having the gradient 1/2 extends by the XY-discharge until the applied voltage vector that extends as the applied voltage increases reaches the intersection 1' with the line having the gradient 1/2. When the applied voltage becomes the value corresponding to the intersection 1', the cell voltage point reaches the simultaneous discharge point I. Since the XY-discharge and the AY-discharge are generated simultaneously at this point, the cell voltage of the XY-interelectrode is kept at $Vt_{XY}$, and the cell voltage of the AY-interelectrode is kept at $Vt_{AY}$. Namely, after the applied voltage vector reaches the intersection 1', the cell voltage point is clipped to the simultaneous discharge point.

[Analysis of Initialization by Two-Stage Obtuse Waveform Pulse Application]

Figure 5:
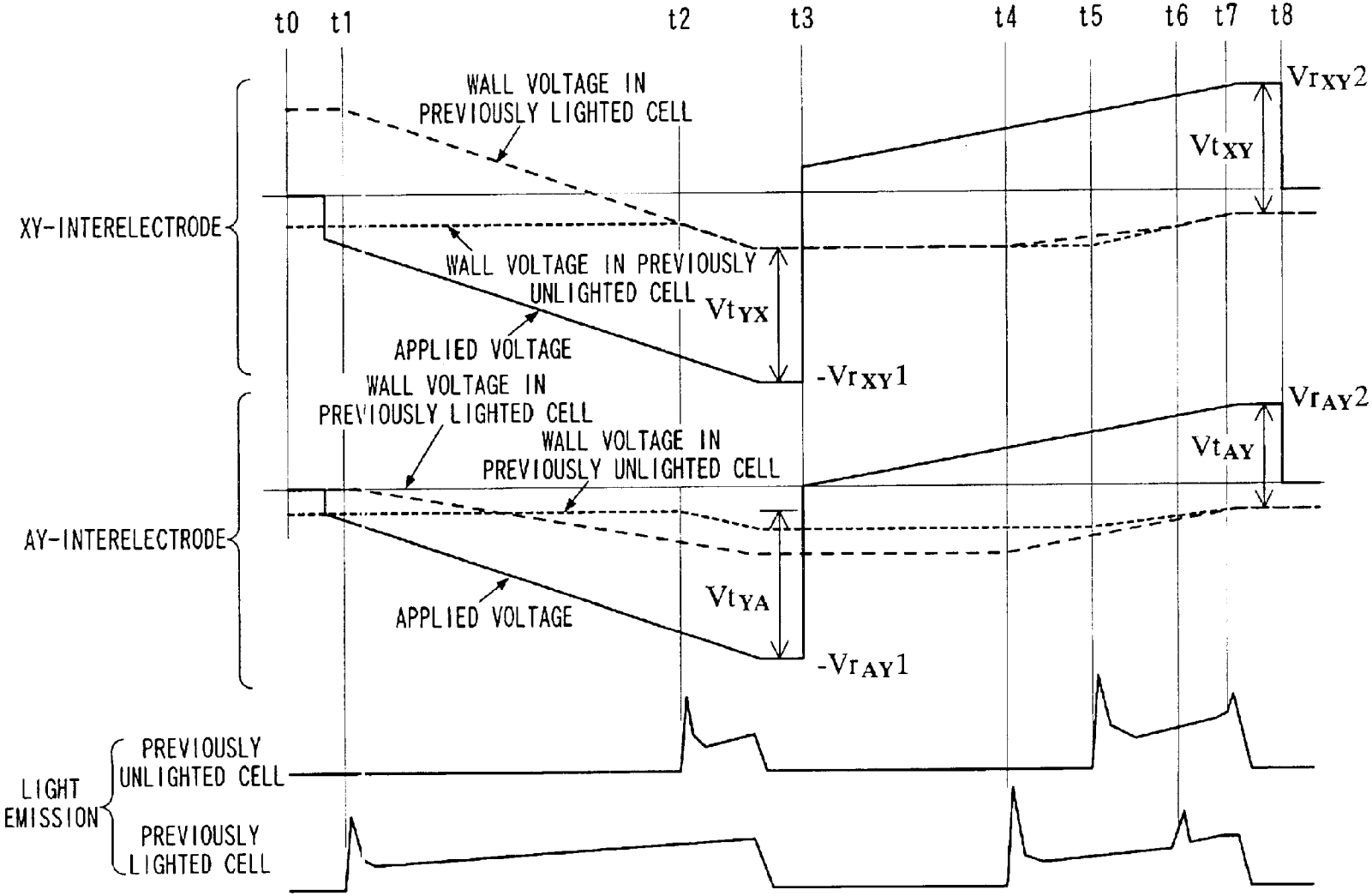
FIG. 5 PRIOR ART
FIG. 5 is a diagram showing the appropriate initialization in the conventional method.
Figure 6:
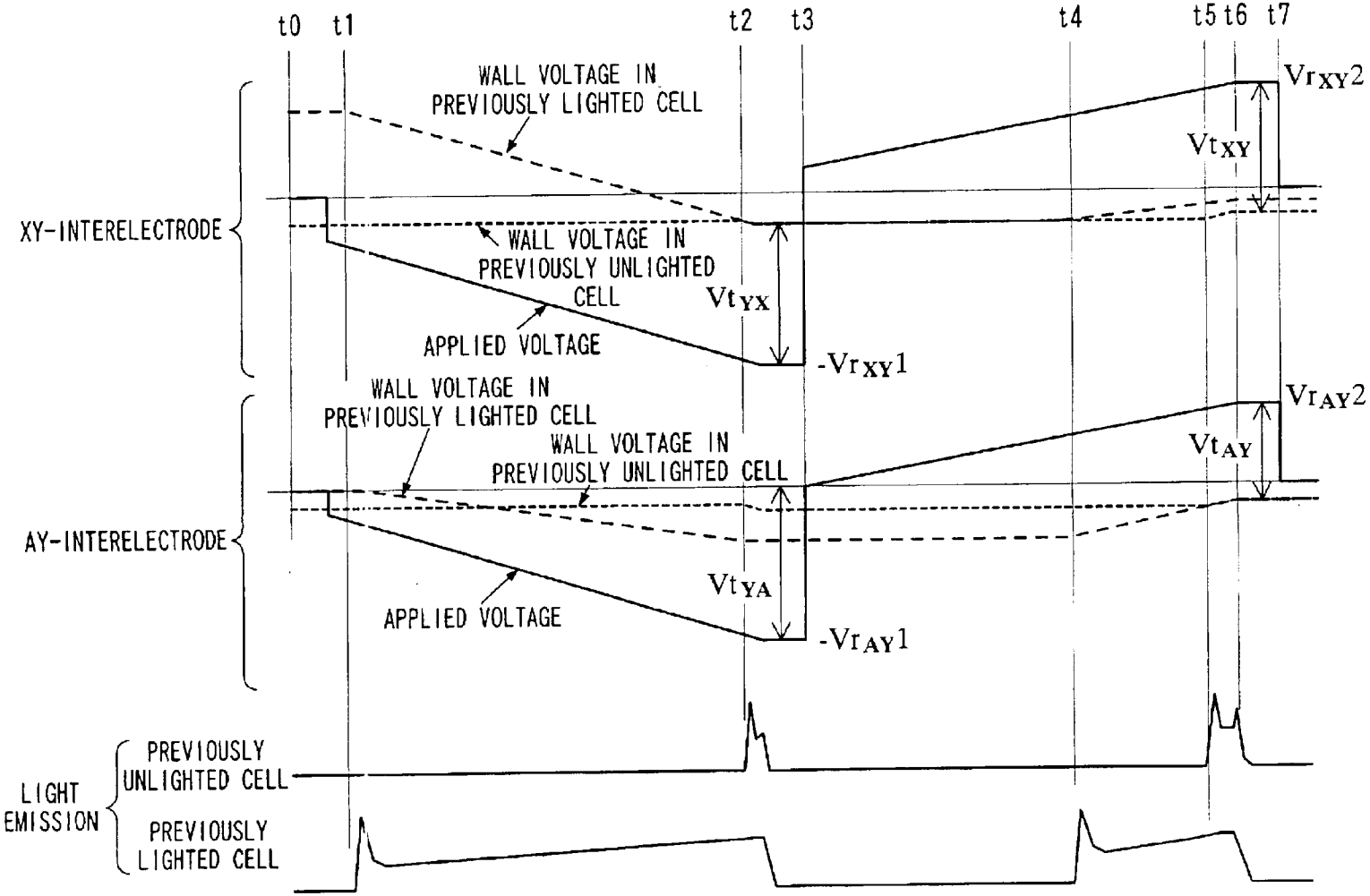
FIG. 6 PRIOR ART
FIG. 6 is a diagram showing the inappropriate initialization in the conventional method.
Figure 13A:
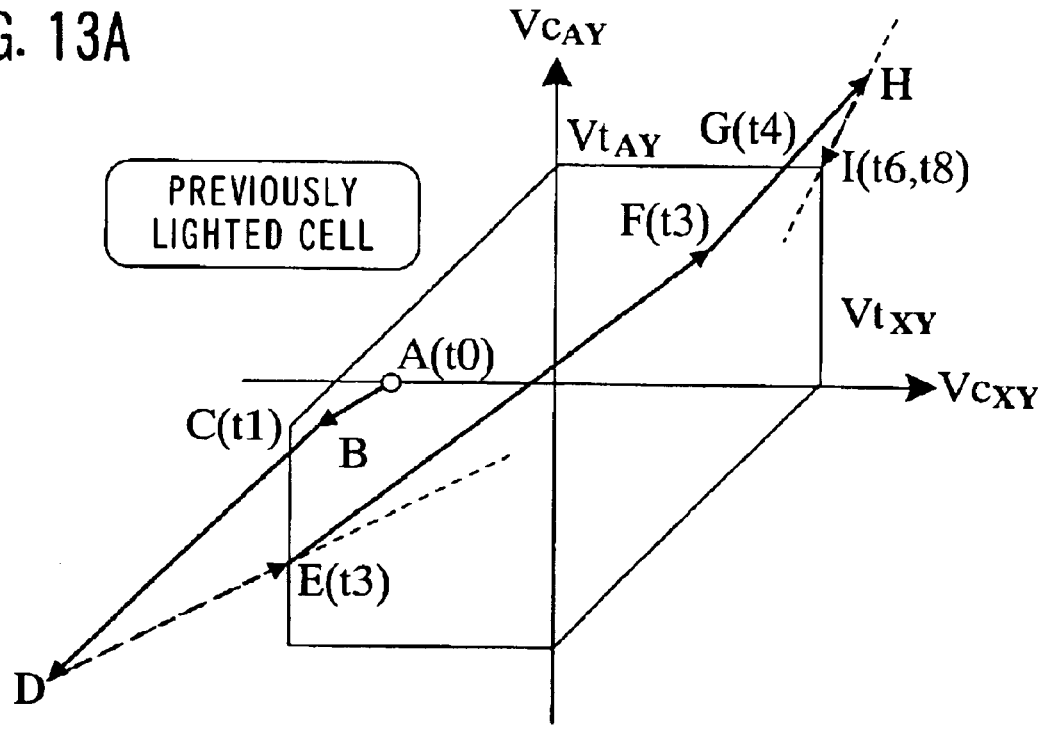
FIGS. 13A and 13B are cell voltage plan views showing the operation shown in FIG. 5.
Figure 13B:
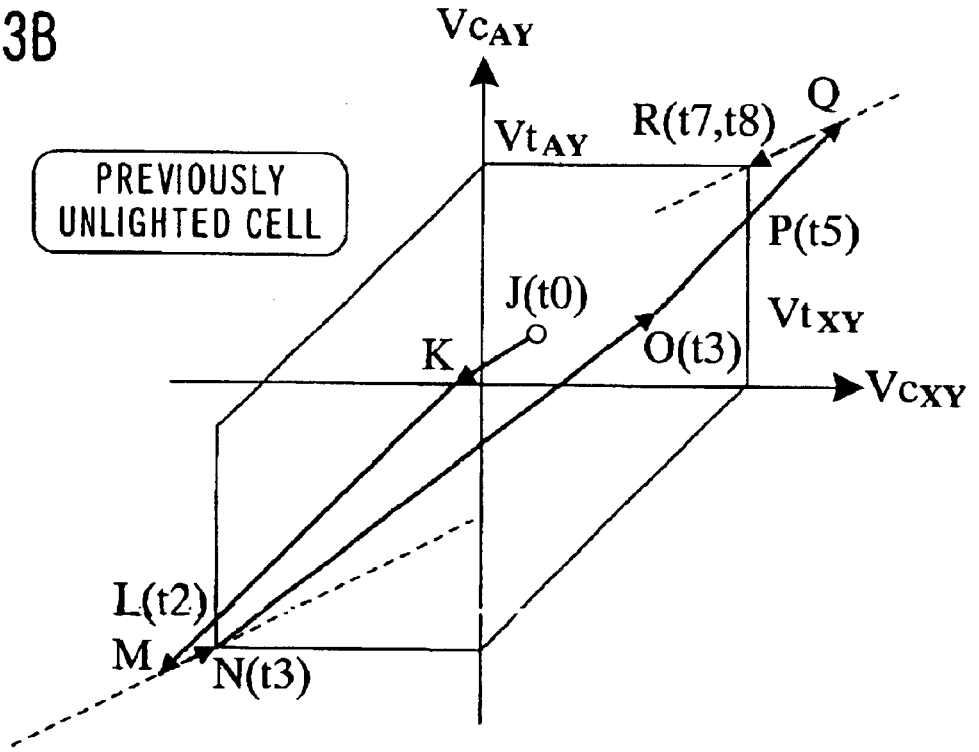
Figure 14A:
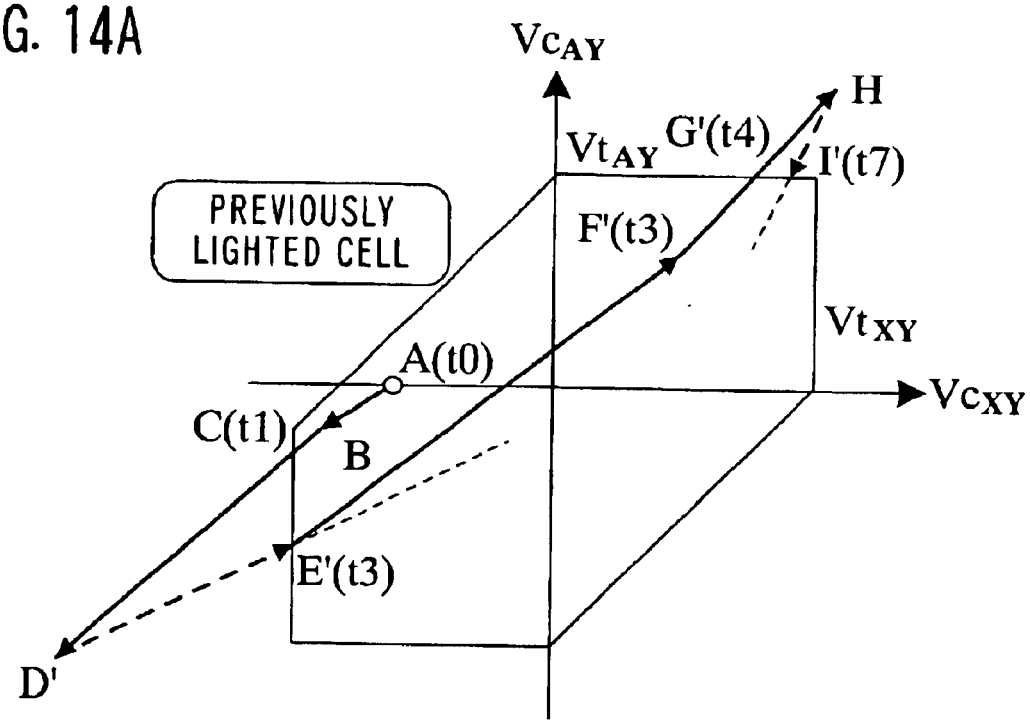
FIGS. 14A and 14B are cell voltage plan views showing the operation shown in FIG. 6.
Figure 14B:
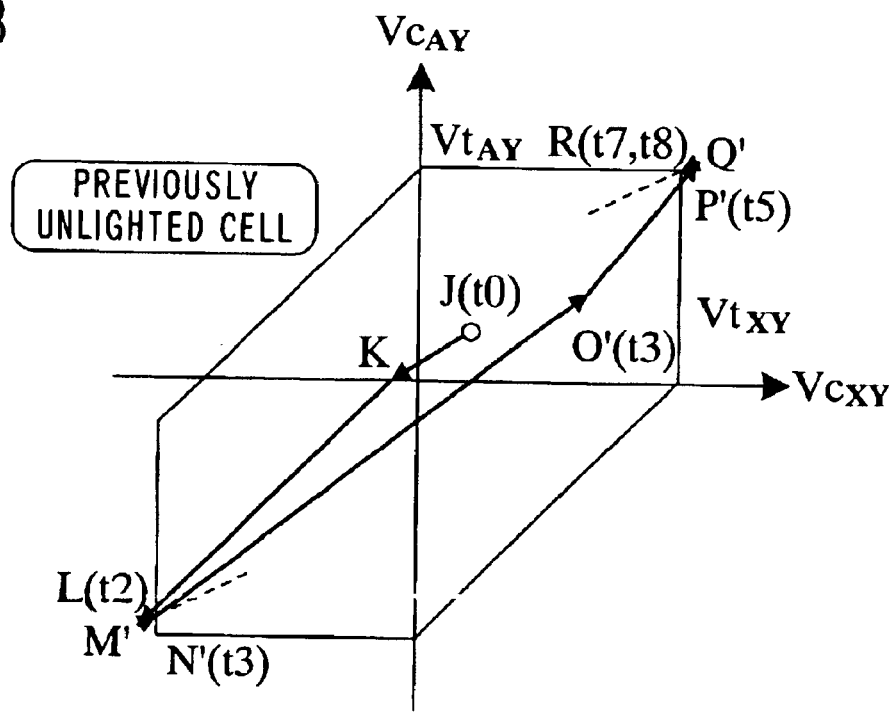

On the basis of the above-mentioned discussion, analysis of the operations shown in FIGS. 5 and 6 will be tried. FIGS. 13A and 13B are cell voltage plan views showing the operation shown in FIG. 5. FIGS. 14A and 14B are cell voltage plan views showing the operation shown in FIG. 6. FIGS. 13A and 14A show operations of the previously lighted cells, while FIGS. 13B and 14B show operations of the previously unlighted cells. The cell voltage position at each time point shown in FIGS. 5 and 6 is indicated with t0, t1,

[Appropriate Initialization]

In FIG. 13A, the cell voltage point of the previously lighted cell at the start time of the initialization is the point A. According to the waveforms shown in FIG. 5, the applied voltage varies like a step at first in the initialization. Therefore the cell voltage point moves to the point B. By applying a negative first obtuse waveform pulse, discharge begins at the point C so that the wall voltage is written. Since the discharge is the XY-discharge, the direction of writing is the direction with the gradient 1/2. The cell voltage point is the point E when the first obtuse waveform pulse application is finished. The cell voltage point moves to the point F corresponding to the rapid variation of the applied voltage at the transition from the first obtuse waveform pulse to the second obtuse waveform pulse. By the second obtuse waveform pulse application, discharge starts at the point G so that the wall voltage is written. Since the discharge is the AY-discharge, the wall voltage is written in the direction with the gradient 2. After the AY-discharge starts, the cell voltage point moves to the right along the Vt closed curve. This means that the cell voltage at the XY-interelectrode is increasing while keeping the cell voltage at the AY-interelectrode at $Vt_{AY}$. When the cell voltage at the XY-interelectrode increases and reaches the threshold level $Vt_{XY}$, discharge starts at the XY-interelectrode and the AY-interelectrode simultaneously. While the simultaneous discharge continues, the wall voltage is written by the increase of the applied voltage so that the cell voltage point is fixed at the point I. Namely, it is understood from FIG. 13A that the initialization is performed appropriately for the previously lighted cell.

If the initialization is performed appropriately as explained above, the cell voltage point just after the initialization is finished is the upper right vertex of the Vt closed curve that is a hexagon, i.e., the simultaneous initialization point indicating the condition of the simultaneous discharge.

In FIG. 13B, the cell voltage point of the previously unlighted cell at the initialization start time is the point J. Since the applied voltage varies like a step at first in the initialization according to the waveforms shown in FIG. 5, the cell voltage point moves to the point K. The negative first obtuse waveform pulse application causes discharge at the point L so that the wall voltage is written. Since the discharge is the XY-discharge, the direction of writing is the direction with the gradient 1/2. The cell voltage point when the first obtuse waveform pulse application is finished is the point N. In accordance with the rapid change of the applied voltage at the transition from the first obtuse waveform pulse to the second obtuse waveform pulse, the cell voltage point moves to the point O. The second obtuse waveform pulse application makes discharge start at the point P so that the wall voltage is written. Since the discharge is the XY-discharge, the wall voltage is written in the direction with the gradient 1/2. When the XY-discharge starts, the cell voltage point moves upward along the Vt closed curve. This means that the cell voltage at the AY-interelectrode is increasing while the cell voltage at the XY-interelectrode is kept at $Vt_{XY}$. If the cell voltage of the AY-interelectrode increases and reaches the threshold level $Vt_{AY}$, discharge is generated at the XY-interelectrode and the AY-interelectrode simultaneously. While the simultaneous discharge continues, the wall voltage is written by the increase of the applied voltage. Therefore, the cell voltage point is fixed to the point R. Namely, it is understood from FIG. 13B that the initialization is performed appropriately for the previously unlighted cell.

[Inappropriate Initialization]

Also in FIG. 14A, the cell voltage point of the previously lighted cell at the initialization start time is the point A similarly to FIG. 13A. Since the applied voltage changes like a step at first in the initialization according to the waveform shown in FIG. 6, the cell voltage point moves to the point B. The negative first obtuse waveform pulse application causes discharge to start at the point C so that the wall voltage is written. The state transition hitherto is the same as in FIG. 13A. The cell voltage point when the first obtuse waveform pulse application is finished is the point E' that is a little above the point E shown in FIG. 13A. In accordance with the rapid change of the applied voltage at the transition from the first obtuse waveform pulse to the second obtuse waveform pulse, the cell voltage point moves to the point F'. The second obtuse waveform pulse application causes discharge to start at the point G' so that the wall voltage is written. Since the discharge is the AY-discharge, the wall voltage is written in the direction with the gradient 2. After the AY-discharge starts, the cell voltage point moves to the right along the Vt closed curve. This corresponds that the cell voltage at the XY-interelectrode is increasing while the cell voltage at the AY-interelectrode is kept at $Vt_{AY}$. However, since the applied voltage does not increase sufficiently, the cell voltage at the XY-interelectrode does not reach the threshold level $Vt_{XY}$. Namely, the cell voltage point does not move to the simultaneous initialization point. In this case, the result of the initialization shows that though the wall voltage at the AY-interelectrode is as preset, the wall voltage at the XY-interelectrode is not as preset. It is understood from FIG. 14A that the initialization is not performed appropriately for the previously lighted cell.

Also in FIG. 14B, the cell voltage point of the previously lighted cell at the initialization start time is the point J similarly to FIG. 13B. According to the waveform shown in FIG. 6, the applied voltage varies like a step at first in the initialization. Therefore, the cell voltage point moves to the point K. The negative first obtuse waveform pulse application causes discharge to start at the point L so that the wall voltage is written. The state transition hitherto is the same as in FIG. 13B. The cell voltage point when the first obtuse waveform pulse application is finished is the point N'. In accordance with the rapid change of the applied voltage at the transition from the first obtuse waveform pulse to the second obtuse waveform pulse, the cell voltage point moves to the point O'. The second obtuse waveform pulse application causes discharge to start at the point P' so that the wall voltage is written. Since the discharge is the XY-discharge, the wall voltage is written in the direction with the gradient 1/2. After the XY-discharge starts, the cell voltage point moves upward along the Vt closed curve. This means that the cell voltage at the AY-interelectrode is increasing while the cell voltage at the XY-interelectrode is kept at $Vt_{XY}$. If the cell voltage at the AY-interelectrode increases and reaches the threshold level $Vt_{AY}$, the XY-discharge and the AY-discharge are generated simultaneously. While the simultaneous discharge continues, the cell voltage point is fixed to the point R (the simultaneous initialization point). Namely, it is understood from FIG. 14B that the initialization is performed appropriately for the unlighted cell.

[Condition for Appropriate Initialization]

Next, the reason why the wall voltage is set or is not set as expected by the initialization utilizing an obtuse waveform pulse will be considered.

Figure 3:
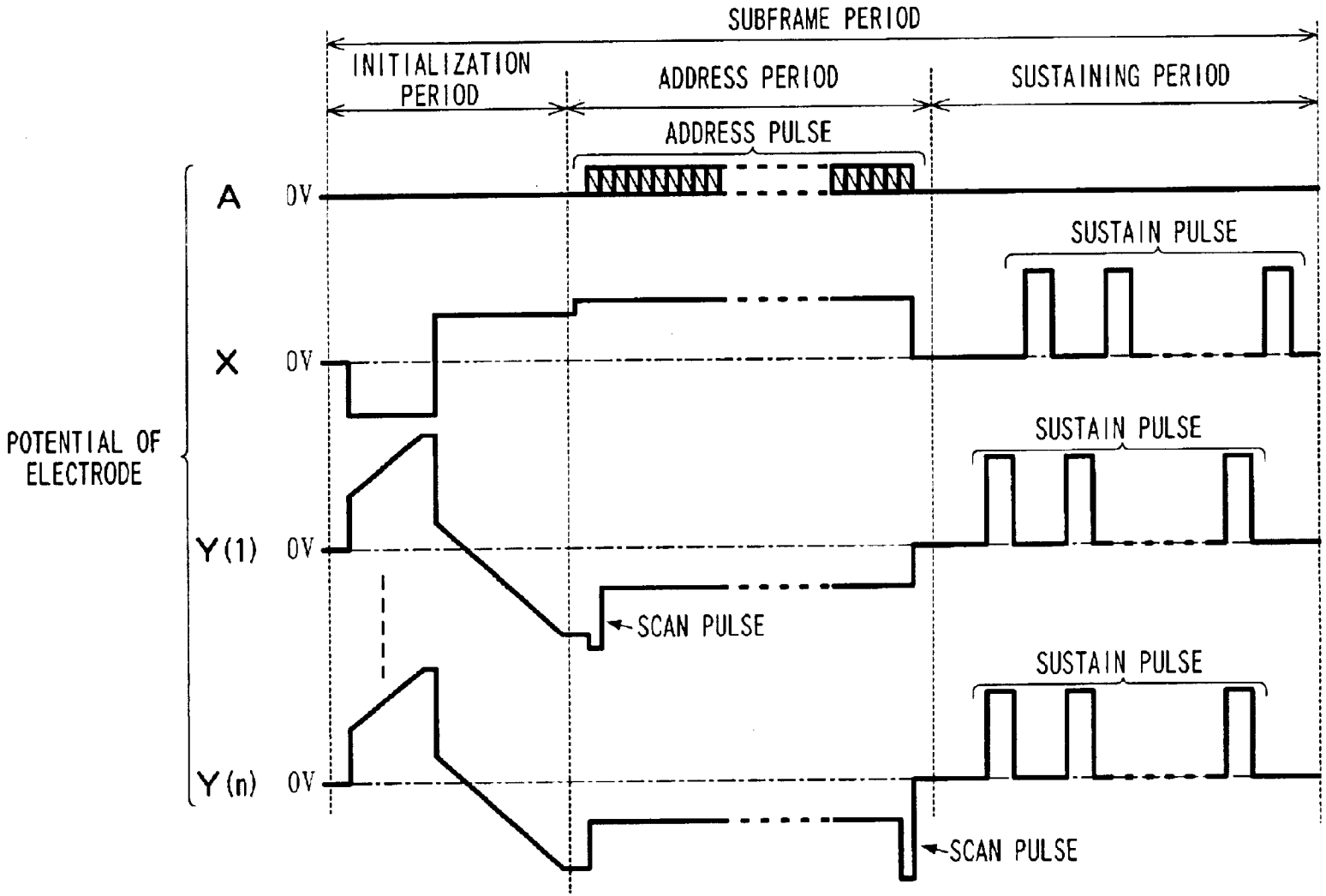
FIG. 3 PRIOR ART
FIG. 3 is a diagram showing the conventional drive waveforms.
Figure 4:
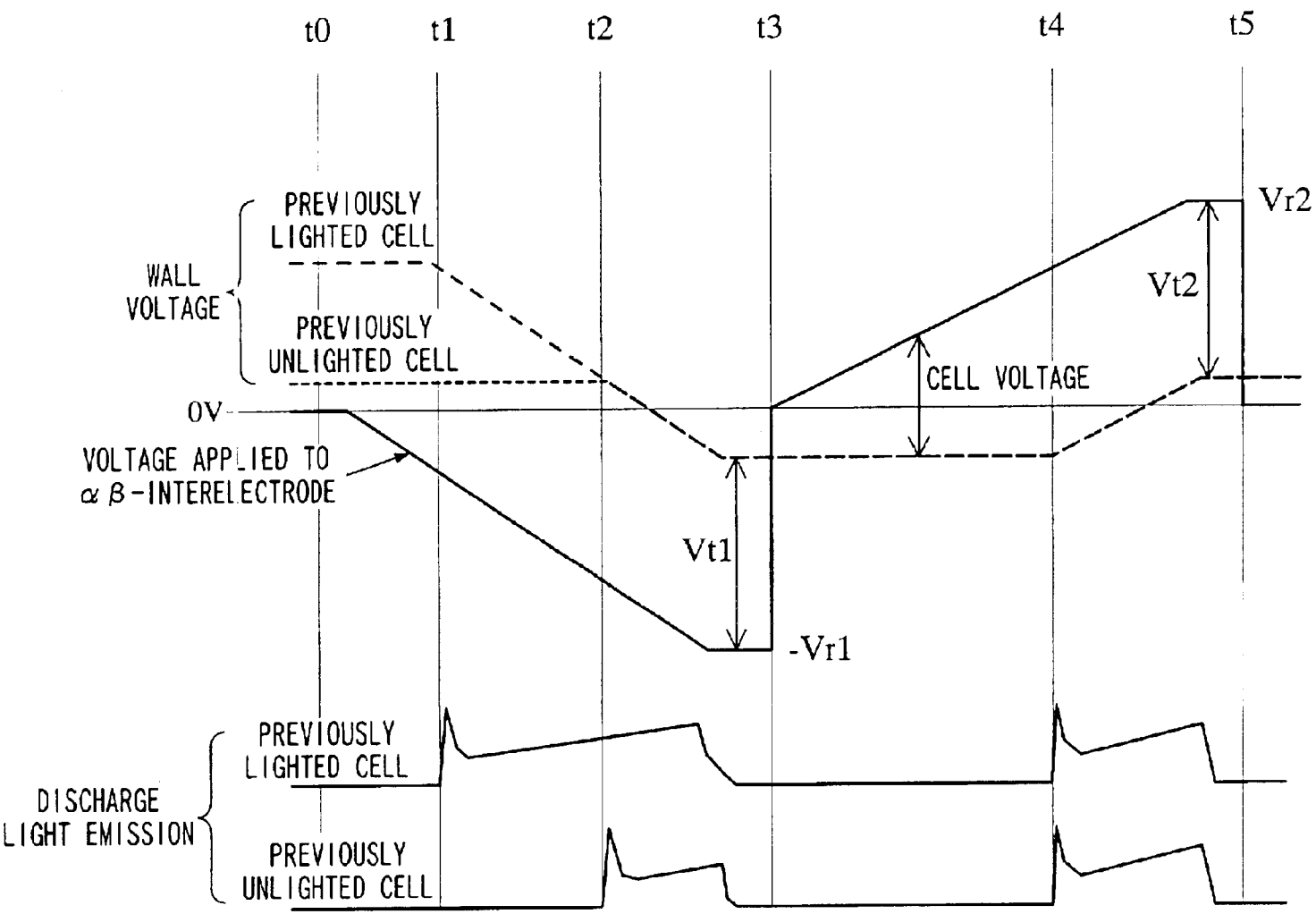
FIG. 4 PRIOR ART
FIG. 4 is a diagram for explaining a principle of the conventional initialization.
Figure 15:
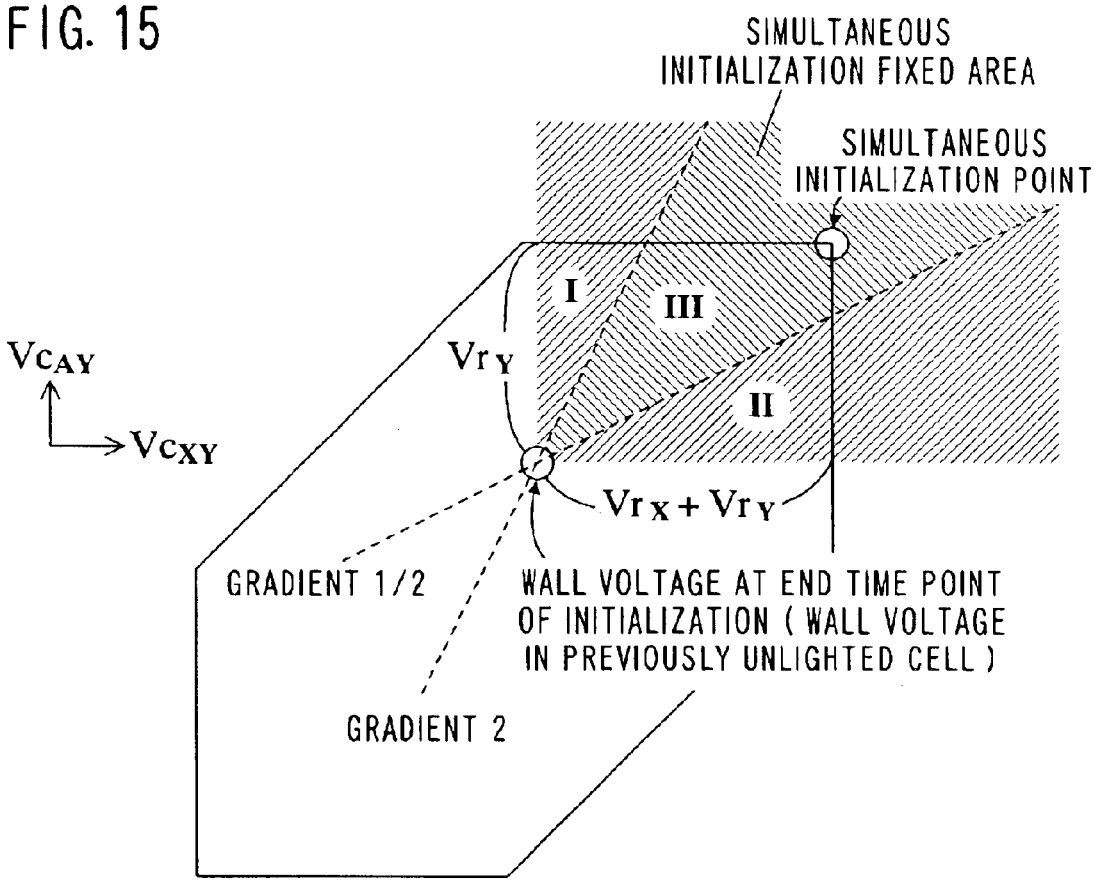
FIG. 15 is an explanatory diagram for conditions for the appropriate initialization.

FIG. 15 is an explanatory diagram for conditions for the appropriate initialization. Here, it is supposed that the initialization is performed by two-stage obtuse waveform pulse application to which the drive waveform shown in FIG. 3 is applied. In the last obtuse waveform pulse application (the second stage shown in FIG. 3), the X electrode potential at the end time point is represented by $+Vr_X$, and the potential of the display electrode Y is represented by $-Vr_Y$.

If the initialization is as expected, the cell voltage point at the end time point is a simultaneous initialization point. Therefore, the point that is shifted from the simultaneous initialization point leftward by $Vr_X+Vr_Y$ and downward by $Vr_Y$ is the wall voltage point after the initialization. Since the wall voltage hardly changes in the unlighted cell during the address period and the sustaining period, the wall voltage point in the previously unlighted cell (the unlighted cell in the previous subframe) when the initialization as preparation for addressing of a certain subframe is started is the simultaneous initialization point or the vicinity thereof.

For the initialization is performed as expected, discharge must be generated at the final obtuse waveform pulse application. The area that satisfies this condition is the upper right area from the wall voltage point after the initialization. The discharge due to the final obtuse waveform pulse application includes some cases. In a first case, it moves to the simultaneous discharge. In a second case, it is only the XY-discharge without moving to the simultaneous discharge. In a third case, it is only the AY-discharge without moving to the simultaneous discharge. The areas corresponding to these three cases are denoted by III, II and I, respectively in FIG. 15. The three areas are defined by two lines that pass the wall voltage point after the initialization and have the gradient 2 and the gradient 1/2. The appropriate initialization is performed securely by the final obtuse waveform pulse application only in the area III shown in FIG. 15. This area is called a "simultaneous initialization fixed area".

[Limitations of Two-Stage Initialization]

It was found from the above consideration that both the wall voltage points in the previously lighted cell and in the previously unlighted cell must be moved to the simultaneous initialization fixed area by a certain operation before the last obtuse waveform pulse application is started. Therefore, it will be considered to solve the problem by the two-stage obtuse waveform pulse application similar to the conventional method.

Figure 16:
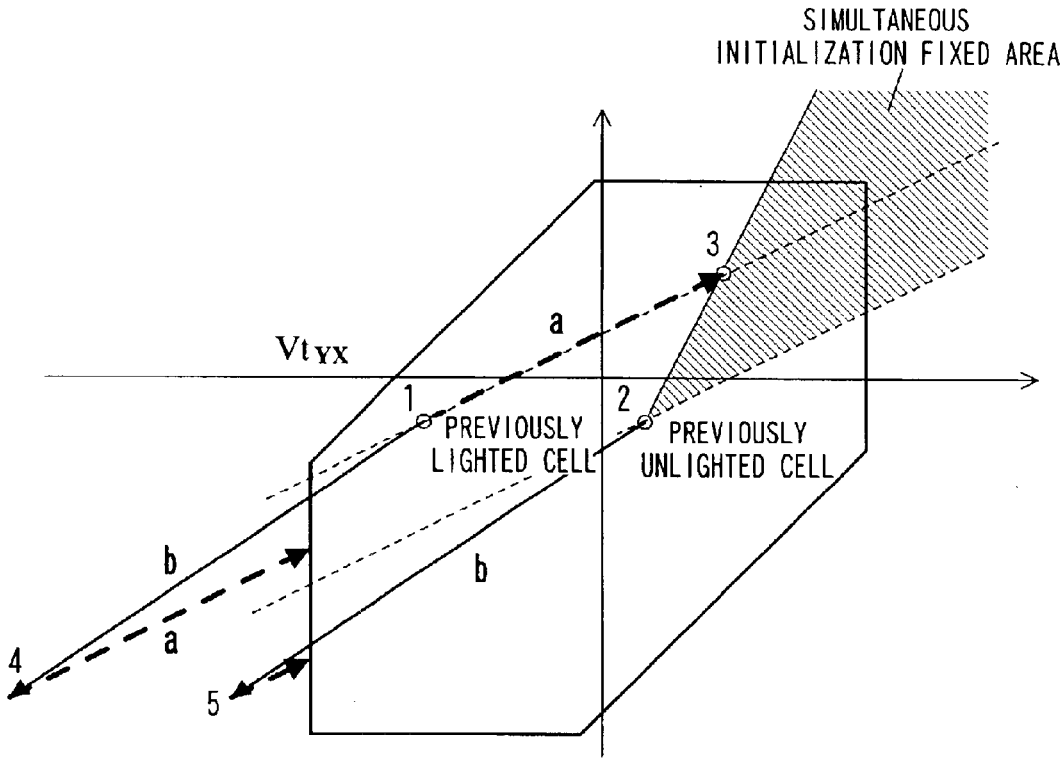
FIG. 16 is an explanatory diagram of an operation for moving the wall voltage point in the previously lighted cell to the simultaneous initialization fixed area by the first stage obtuse waveform pulse in the initialization by the two-stage obtuse waveform pulse application.

FIG. 16 is an explanatory diagram of an operation for moving the wall voltage point in the previously lighted cell to the simultaneous initialization fixed area by the first stage obtuse waveform pulse application in the initialization by the two-stage obtuse waveform pulse application. At the start time of the first stage obtuse waveform pulse application, the cell voltage point in the previously lighted cell is the point 1, and the cell voltage point in the previously unlighted cell is the point 2. The line that passes the point 1 and has the gradient 1/2 crosses the simultaneous initialization fixed area at the point 3.

The vector of movement of the cell voltage point in the previously lighted cell from the point 1 to the simultaneous initialization fixed area by the XY-discharge must be larger than the vector a (=vector 13). The applied voltage vector that satisfies this condition and is for moving the cell voltage point in the previously lighted cell to the simultaneous initialization fixed area is the vector b from the point 1 to the point 4. This is a vector that reaches the left edge side of the Vt closed curve (the side of the threshold level $-Vt_{XY}$) when moving from the end point 4 by the vector a. Since this vector b is also applied to the previously unlighted cell, a lot of wall voltage is written in the previously unlighted cell by the first obtuse waveform pulse application. The quantity of the written wall voltage vector is proportional to the distance between the line that passes the wall voltage point in the previously lighted cell and has the gradient 1/2 and the line that passes the wall voltage point in the previously unlighted cell and has the gradient 1/2. Namely, in the two-stage initialization, the cell voltage point in the previously lighted cell is moved to the simultaneous initialization fixed area, so the light emission quantity in the previously unlighted cell increases.

[Initialization According to the Driving Method of the Present Invention]

[First Form]

According to the above consideration, one effective operation for solving the problem was derived. The operation is to move the wall voltage point in the previously lighted cell to be close to the line that passes the wall voltage point in the previously unlighted cell and has the gradient 1/2 before starting the two-stage obtuse waveform pulse application. This operation is realized by adding another obtuse waveform pulse before the two-stage obtuse waveform pulse application. The pulse to be added is not necessarily an obtuse waveform pulse but can be a high frequency wave pulse. However, an obtuse waveform pulse is the most appropriate for not making the driving circuit complicated. Since a new obtuse waveform pulse is added, the structure of the initialization has three stages. Hereinafter, the obtuse waveform pulse that is relevant to the operation unique to the present invention is referred to as an "additional obtuse waveform pulse" for discriminating it from two other obtuse waveform pulse.

Figure 17:
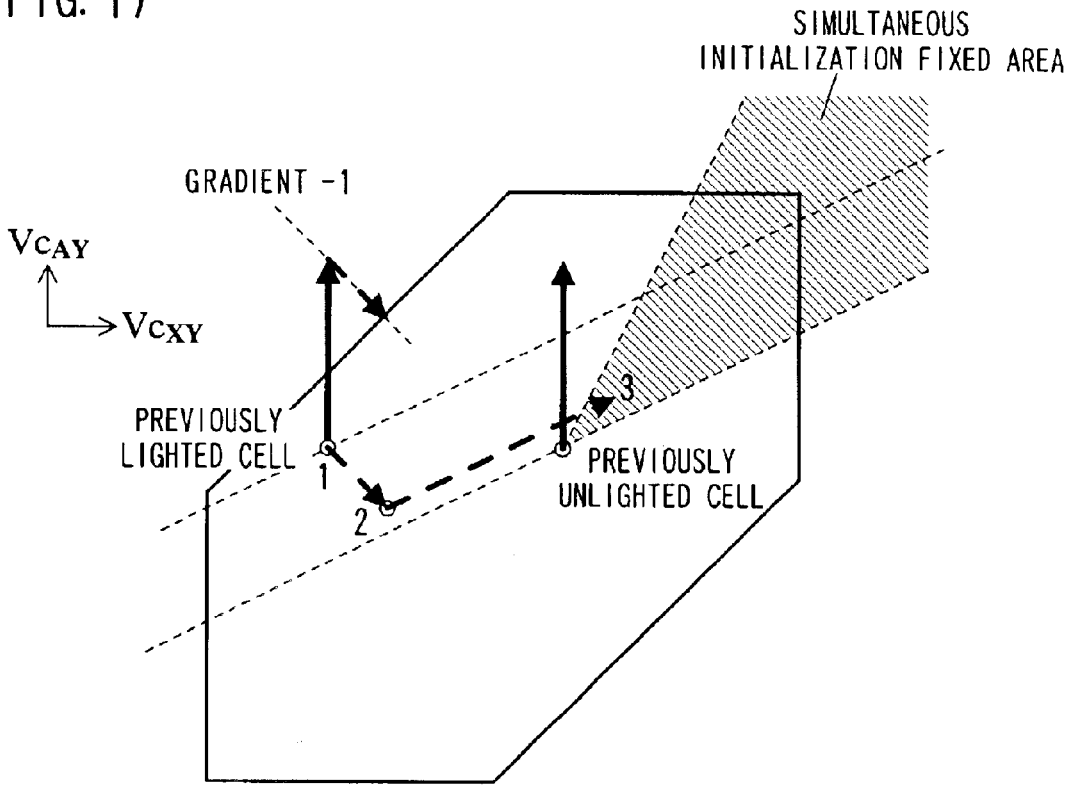
FIG. 17 is an explanatory diagram of the principle of the present invention.

FIG. 17 is an explanatory diagram of the principle of the present invention. In order to make the wall voltage in the previously lighted cell approach to the above-mentioned line, it is necessary to generate the AY-discharge or the AX-discharge. It is determined by the final display discharge in the sustaining period which discharge is preferable. If the anode of the final display discharge is the X electrode for example, the wall voltage point in the previously lighted cell is located at the left side of the vertical axis on the cell voltage plane at the start time in the initialization period after the sustaining period. In this case, the wall voltage point in the previously lighted cell can be close to the above-mentioned line more efficiently by the AX-discharge than by the AY-discharge. The AX-discharge is generated by the applied voltage vector indicated by the solid line arrow in FIG. 17, and it causes the wall voltage written in the direction with the gradient −1. Dissipation of the applied voltage vector, i.e., finish of the voltage application corresponds to the parallel movement of the wall voltage vector in the reverse direction of the solid line arrow in FIG. 17. Therefore, the AX-discharge causes the movement of the wall voltage point in the previously lighted cell from the point 1 to the point 2, so as to approach to the line that passes the wall voltage point in the previously unlighted cell and has the gradient 1/2 and also approach to the wall voltage point in the previously unlighted cell naturally. The applied voltage vector that generates the AX-discharge is also applied to the previously unlighted cell. However, if the applied voltage vector does not reach the Vt closed curve, neither discharge nor undesired light emission is generated. When selecting the size of the applied voltage vector for generating the AX-discharge, it should be considered that discharge is not generated in the previously unlighted cell. If the wall voltage point in the previously lighted cell is close to the above-mentioned line due to the AX-discharge, the movement from the point 2 to the simultaneous initialization fixed area may be achieved in the second stage obtuse waveform pulse application. The applied voltage vector necessary for the achievement is smaller than the applied voltage vector necessary for movement from the point 1 to the simultaneous initialization fixed area. Namely, it is possible to move the wall voltage points in the previously lighted cell and the previously unlighted cell to the simultaneous initialization fixed area without lighting the previously unlighted cell. If the wall voltage point is in the simultaneous initialization fixed area, the wall voltage can be set to a desired value securely by the final (the third stage) obtuse waveform pulse application.

Figure 18:
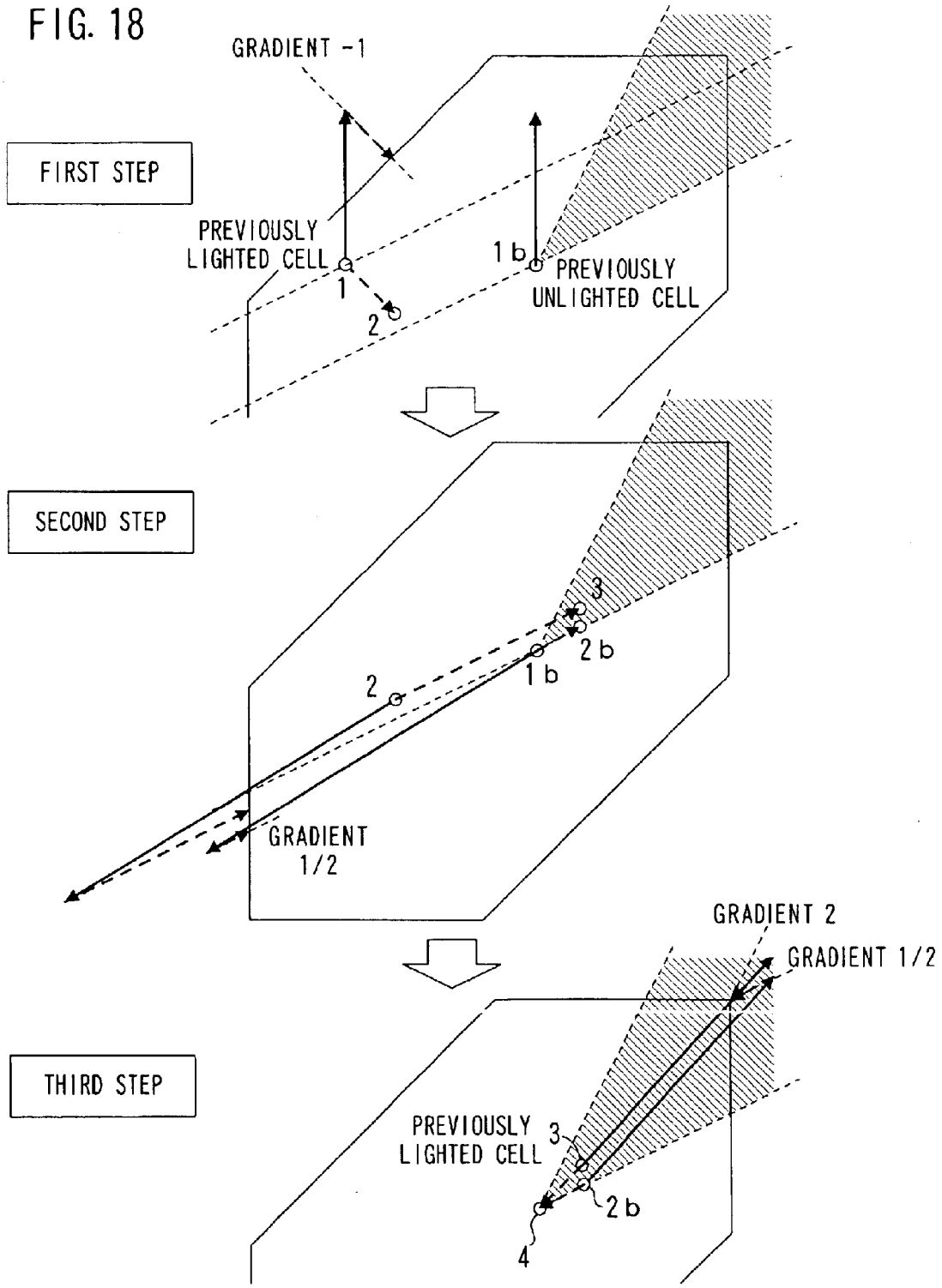
FIG. 18 shows the initialization procedure according to the present invention.

FIG. 18 shows the initialization procedure according to the present invention. In the first step, the wall voltage point 1 in the previously lighted cell is moved to the point 2 so as to approach the wall voltage point 1*b* in the previously unlighted cell. In the second step, the wall voltage point 2 in the previously lighted cell is moved to the point 3 in the simultaneous initialization fixed area. On this occasion, the wall voltage point 1*b* in the previously unlighted cell moves to the point 2*b* in the simultaneous initialization fixed area. In the final third step, the simultaneous discharge is generated so that the wall voltage points in the previously lighted cell and the previously unlighted cell are aligned to the point 4.

[Second Form]

Figure 19:
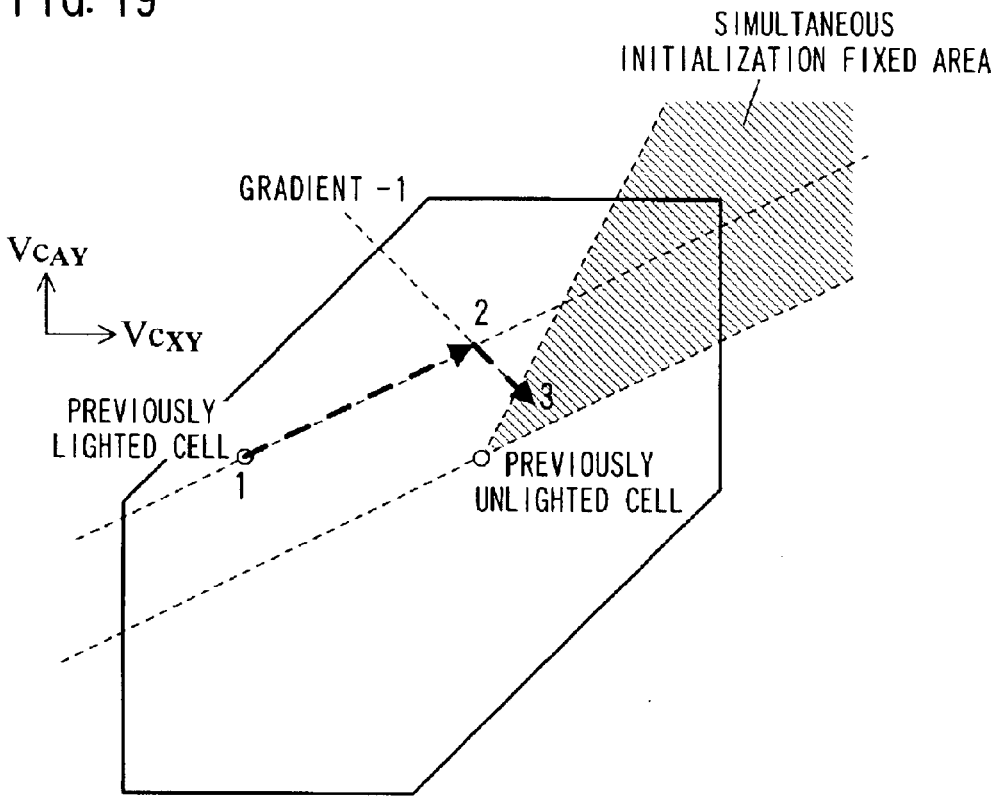
FIG. 19 is an explanatory diagram of the principle of the present invention.

In the first form explained above, an additional obtuse waveform pulse is applied as the first operation in the three-stage initialization. In contrast, in the second form, an additional obtuse waveform pulse is applied as the second operation in the three stages. Namely, as shown in FIG. 19, the wall voltage point in the previously lighted cell is moved from the point 1 to the point 2 that is closer to the simultaneous initialization fixed area in the obtuse waveform pulse application of the first stage, and after that the wall voltage point in the previously lighted cell is moved from the point 3 to the simultaneous initialization fixed area by applying the additional obtuse waveform pulse. This corresponds to a form in which the order of the first and the second stages is reversed in the first form. The second form is different from the operation shown in FIG. 16, in which the wall voltage point in the previously lighted cell is forced to move to the simultaneous initialization fixed area by one time of the XY-discharge. The first stage XY-discharge and the second stage AX-discharge (or the AY-discharge) make the wall voltage point in the previously lighted cell move to the simultaneous initialization fixed area. The second stage applied voltage vector must be a vector having a size that does not generate discharge in the previously unlighted cell.

In the second stage operation in the second form, the previously unlighted cell is not lighted. Since the wall voltage points in the previously lighted cell and the previously unlighted cell move to the simultaneous initialization fixed area in the second stage, the simultaneous discharge is generated in the third stage so that the initialization is achieved as expected.

[Example of Drive Waveforms]

Figure 20:
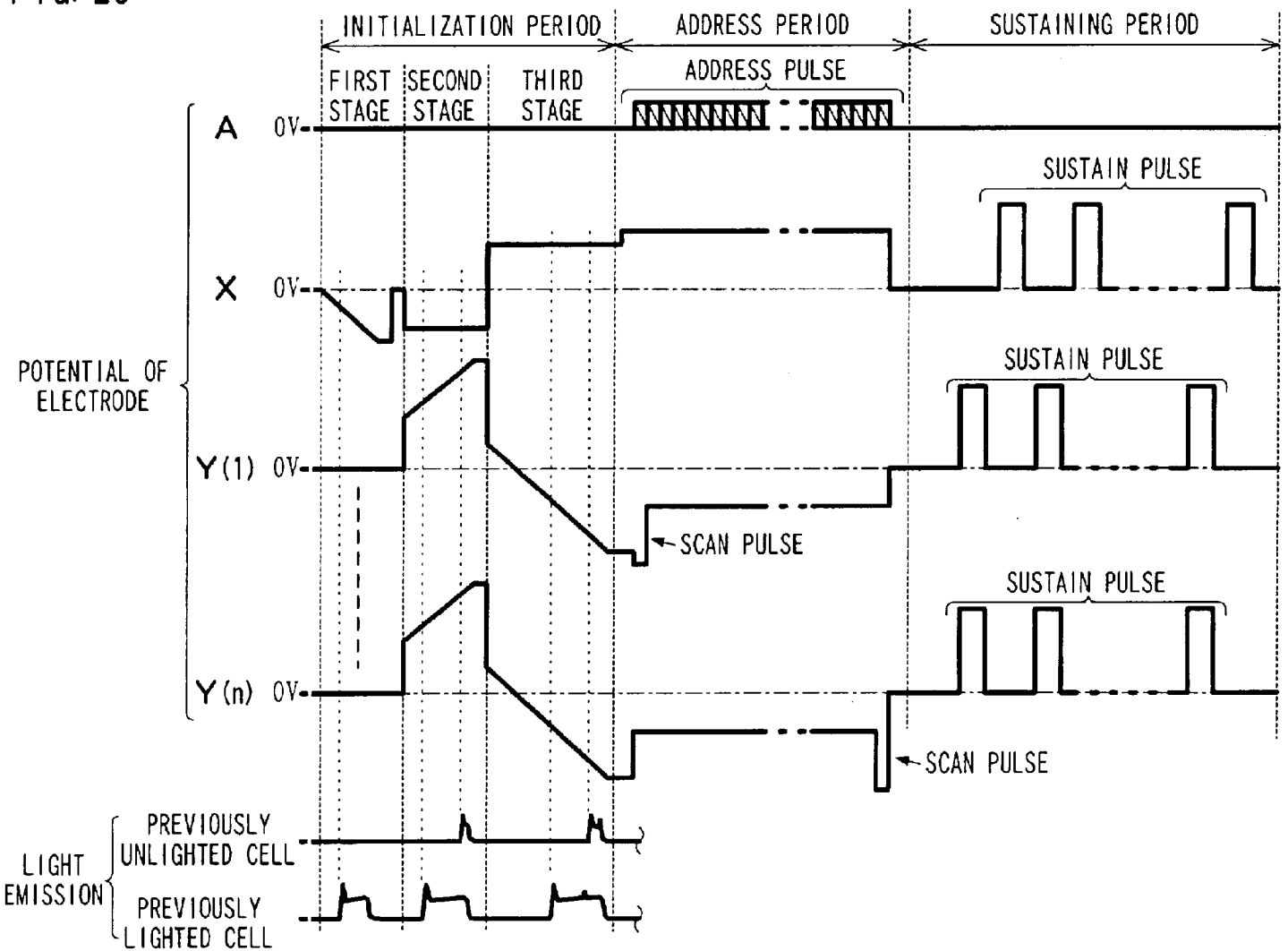
FIG. 20 shows a first example of the drive waveforms.

FIG. 20 shows a first example of the drive waveforms. For one subframe, the initialization, the addressing and the sustaining are performed in the initialization period, the address period and the sustaining period. The drive waveforms in the address period and in the sustaining period are the same as the conventional example shown in FIG. 3.

The initialization includes three stages. In the first stage, a slowly increasing bias is applied to the X electrode; thereby an obtuse waveform pulse is applied to the XY-interelectrode and the AX-interelectrode. In the second stage and the third stage, a slowly increasing bias is applied to the display electrode Y, thereby an obtuse waveform pulse is applied to the XY-interelectrode and the AY-interelectrode. The first stage obtuse waveform pulse of the three stages is the additional obtuse waveform pulse unique to the present invention. Namely, the first example is applied to the first form of the initialization explained above. In the first stage, the descending obtuse waveform pulse is applied to the display electrode X, thereby the AX-discharge is generated only in the previously lighted cell. This discharge makes the wall voltage point in the previously lighted cell approach to the line that passes the wall voltage point in the previously unlighted cell and has the gradient 1/2, so that the applied voltage to be added in the second stage is decreased. Namely, the additional obtuse waveform pulse application reduces the light emission that accompanies the initialization in the previously unlighted cell.

Figure 21:
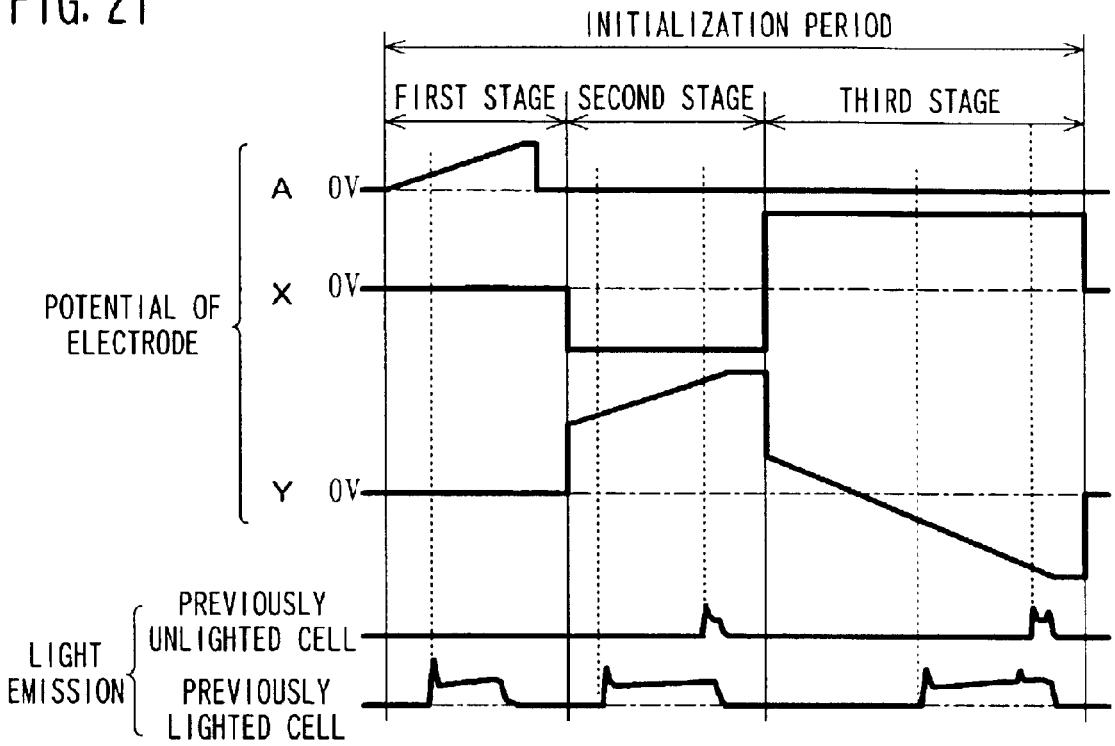
FIG. 21 shows a second example of the drive waveforms.

FIG. 21 shows a second example of the drive waveforms. In the second and following examples, the drive waveforms in the address period and the sustaining period are similar to the conventional example shown in FIG. 3. Therefore, only the waveforms in the initialization period are illustrated. Also in the second example, the obtuse waveform pulse in the first stage of three stages is the additional obtuse waveform pulse unique to the present invention. In the first stage, an ascending obtuse waveform pulse is applied to the address electrode A, so that the AX-discharge is generated only in the previously lighted cell.

Figure 22:
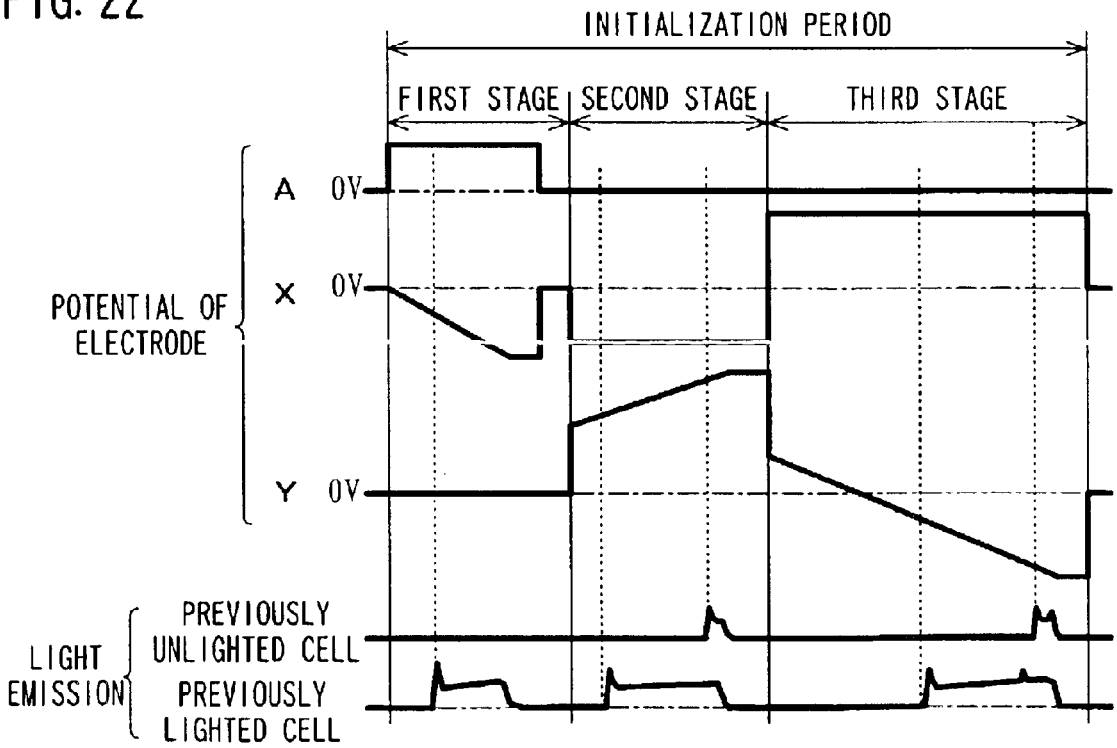
FIG. 22 shows a third example of the drive waveforms.

FIG. 22 shows a third example of the drive waveforms. Also in the third example, the obtuse waveform pulse in the first stage of the three stages is the additional obtuse waveform pulse unique to the present invention. In the first stage, a descending obtuse waveform pulse is applied to the display electrode X and a positive rectangular wave is applied to the address electrode A, so that the AX-discharge will be generated only in the previously lighted cell.

Figure 23:
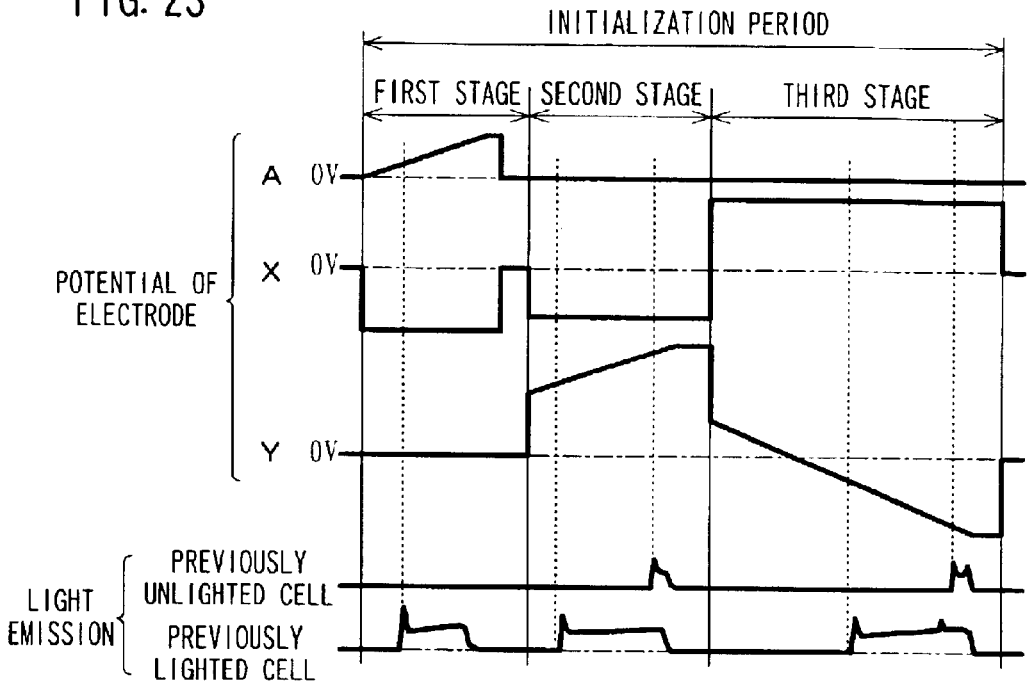
FIG. 23 shows a fourth example of the drive waveforms.

FIG. 23 shows a fourth example of the drive waveforms. Also in the fourth example, the obtuse waveform pulse in the first stage of the three stages is the additional obtuse waveform pulse unique to the present invention. In the first stage, an ascending obtuse waveform pulse is applied to the address electrode A and a negative rectangular wave is applied to the display electrode X, so that the AX-discharge will be generated only in the previously lighted cell.

Figure 24:
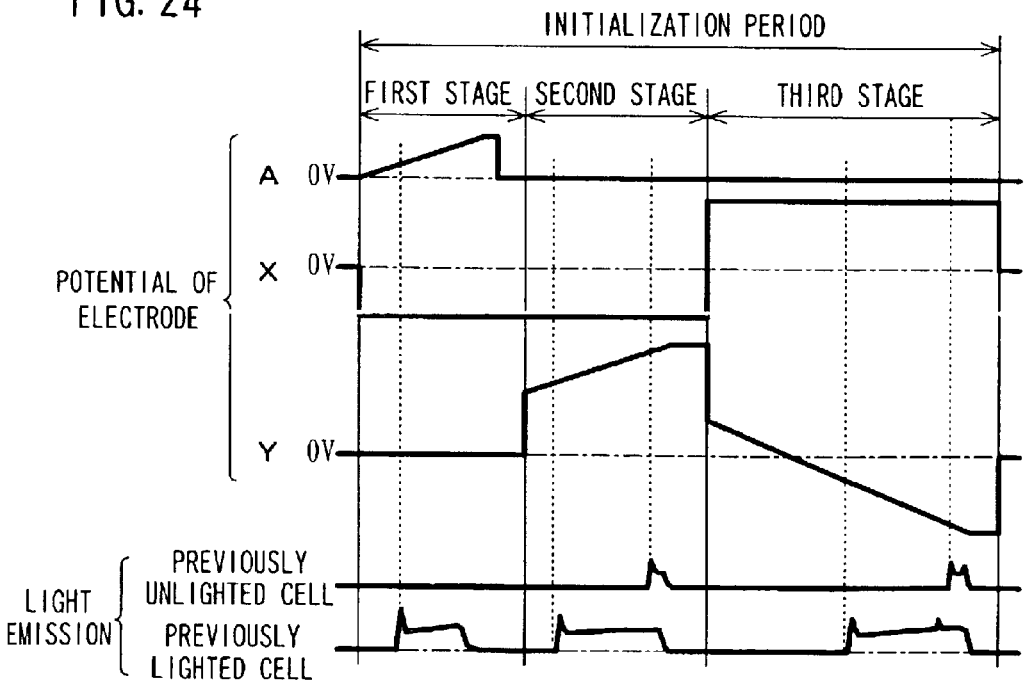
FIG. 24 shows a fifth example of the drive waveforms.

FIG. 24 shows a fifth example of the drive waveforms. The fifth example is a variation of the fourth example. In the fifth example, the amplitudes of the negative rectangular waves that are applied to the display electrode X in the first stage and the second stage are the same. Thus, the number of power sources necessary for driving is reduced, and the driving circuit can be inexpensive.

Figure 25:
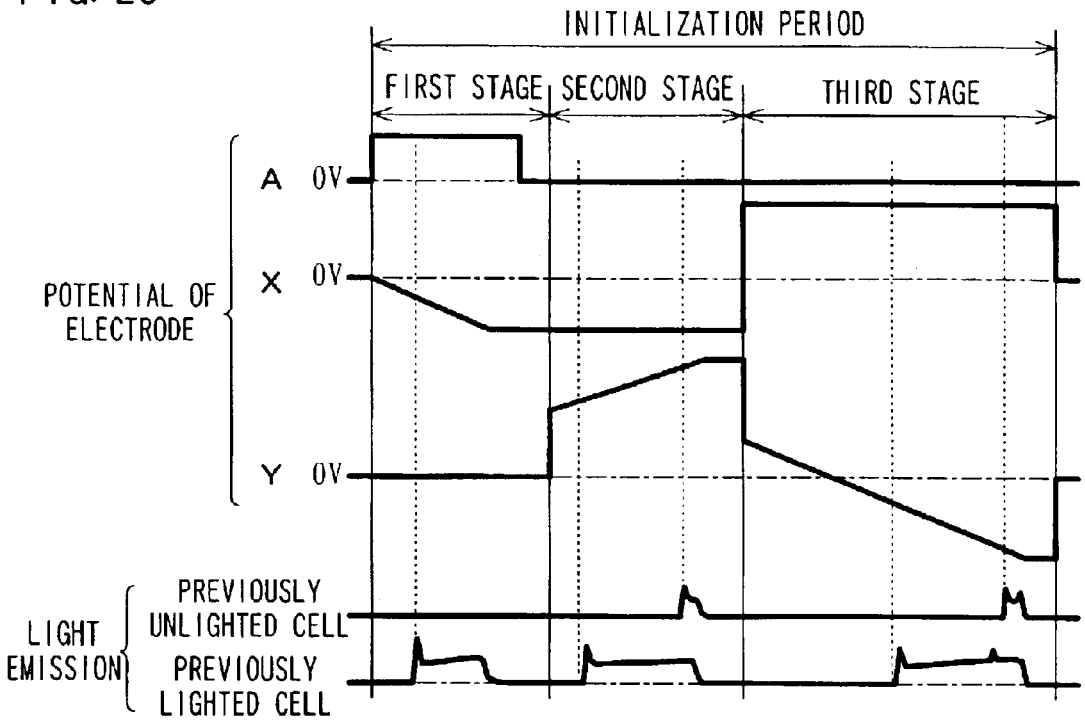
FIG. 25 shows a sixth example of the drive waveforms.

FIG. 25 shows a sixth example of the drive waveforms. The sixth example is a variation of the third example. In the sixth example, the amplitudes of the descending obtuse waveform pulse that is applied to the display electrode X in the first stage and the negative rectangular wave that is applied to the display electrode X in the second stage are the same. Thus, the number of power sources necessary for driving is reduced, and the driving circuit can be inexpensive.

Figure 26:
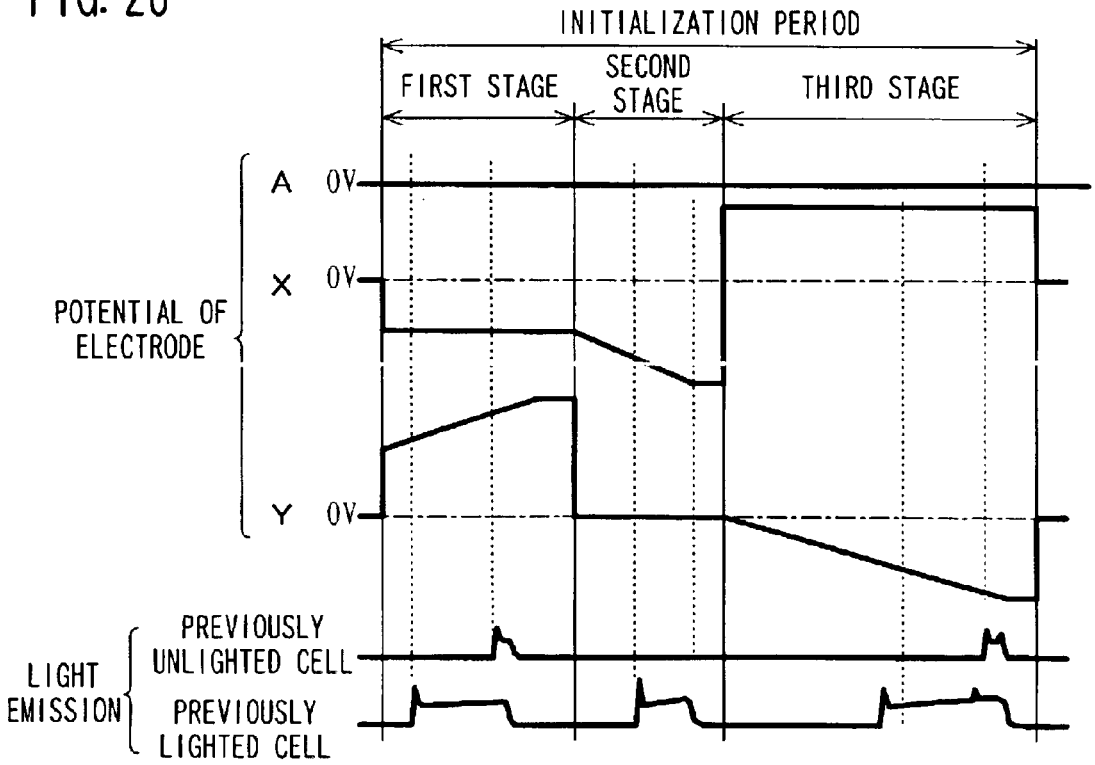
FIG. 26 shows a seventh example of the drive waveforms.

FIG. 26 shows a seventh example of the drive waveforms. In the seventh example, the obtuse waveform pulse in the second stage of the three stages is the additional obtuse waveform pulse unique to the present invention. Namely, the seventh example is applied to the initialization in the above-mentioned second example. In the first stage, an ascending obtuse waveform pulse is applied to the display electrode Y, so that the XY-discharge is generated in the previously lighted cell and in the previously unlighted cell. Since the wall voltage point in the previously lighted cell is not necessarily moved to the simultaneous initialization fixed area in this discharge, the amplitude of the obtuse waveform pulse is decreased so that the background light emission in the previously unlighted cell can be reduced. In the second stage, the negative rectangular wave is applied to the display electrode X, so that the AX-discharge that makes the wall voltage point move to the simultaneous initialization fixed area is generated only in the previously lighted cell.

Figure 27:
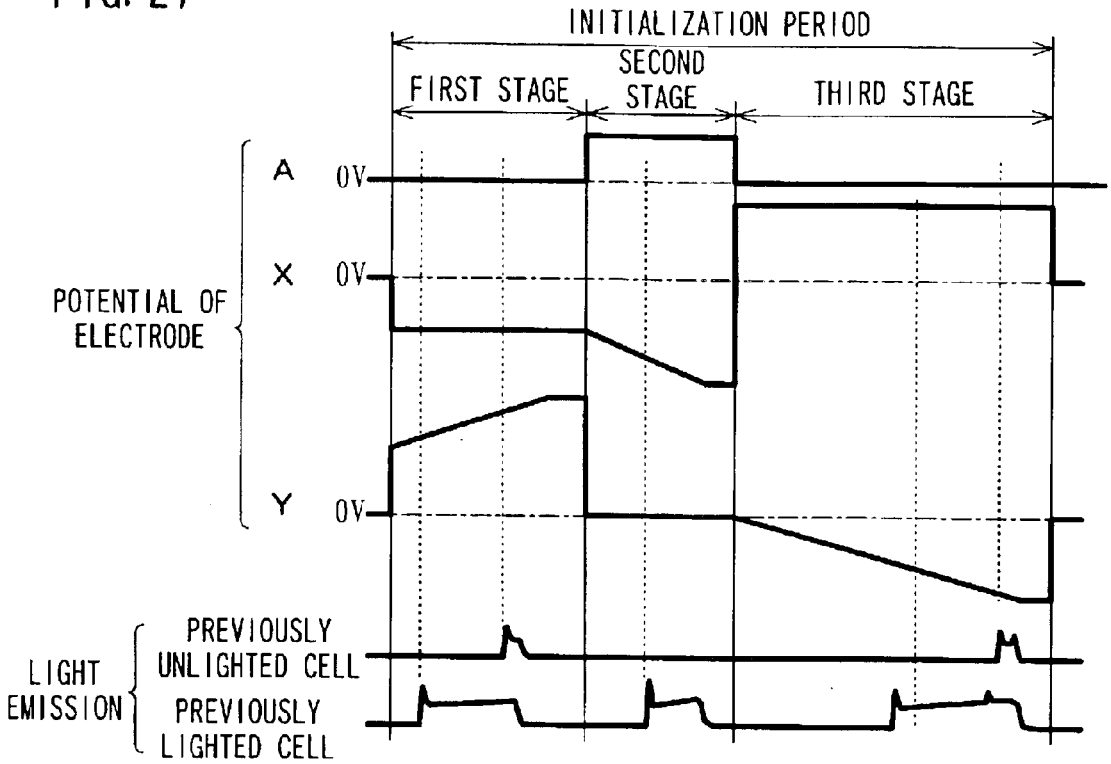
FIG. 27 shows a eighth example of the drive waveforms.

FIG. 27 shows an eighth example of the drive waveforms. Also in the eighth example, the obtuse waveform pulse in the second stage of the three stages is the additional obtuse waveform pulse unique to the present invention. In the second stage, a descending obtuse waveform pulse is applied to the display electrode X and a positive rectangular wave is applied to the address electrode A, so that the AX-discharge is generated only in the previously lighted cell.

Figure 28:
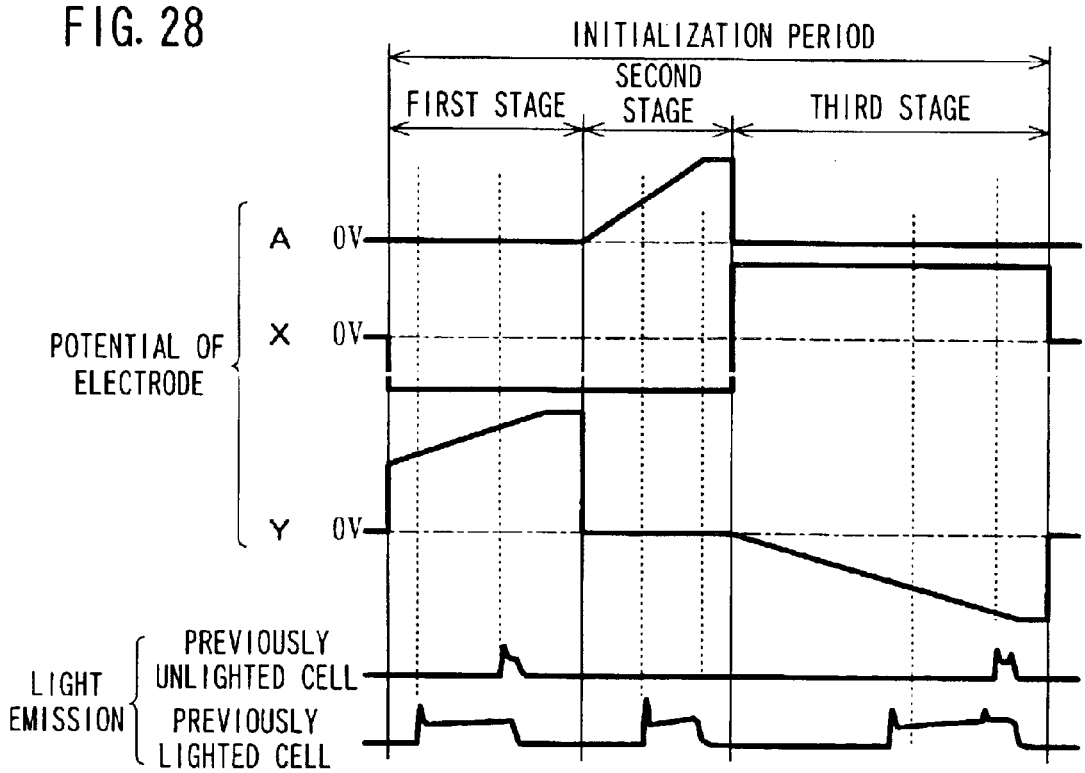
FIG. 28 shows a ninth example of the drive waveforms.

FIG. 28 shows the ninth example of the drive waveforms. Also in the ninth example, the obtuse waveform pulse in the second stage of the three stages is the additional obtuse waveform pulse unique to the present invention. In the second stage, an ascending obtuse waveform pulse is applied to the address electrode A and a negative rectangular wave is applied to the display electrode X, so that the AX-discharge is generated only in the previously lighted cell.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving a three-electrode surface discharge AC type plasma display panel having an electrode matrix including an arrangement of display electrodes and an arrangement of address electrodes, the method comprising:

performing an initialization process for equalizing wall voltage in all cells that constitute a display screen to a preset value, an addressing process for controlling the wall voltage in each cell in accordance with display data and a sustaining process for generating display discharge only in cells to be lighted;

applying an obtuse waveform pulse three times to all cells as an operation of the initialization for simply increasing or decreasing potential of at least one electrode;

in the first obtuse waveform pulse application, generating discharge only in a previously lighted cell that was lighted in the last sustaining before the initialization, so that the wall voltage thereof approaches wall voltage in a previously unlighted cell that was not lighted in the last sustaining;

in the second obtuse waveform pulse application, generating discharge in the previously lighted cell and in the previously unlighted cell, so that the wall voltages in these cells change to a value within an appropriate range; and in the third obtuse waveform pulse application, generating discharge in the previously lighted cell and in the previously unlighted cell, so that the wall voltages in these cells change to the preset value.

2. The method according to claim 1, wherein in the first obtuse waveform pulse application the discharge is generated between the address electrode and the display electrode in the previously lighted cell, in the second obtuse waveform pulse application the discharge is generated between the display electrodes in the previously lighted cell and in the previously unlighted cell, and in the third obtuse waveform pulse application the discharge is generated between the address electrode and the display electrode as well as between the display electrodes in the previously lighted cell and in the previously unlighted cell.

3. The method according to claim 2, wherein in the second obtuse waveform pulse application the discharge is generated between the display electrodes in the previously lighted cell and in the previously unlighted cell in which an anode is a display electrode that is also a scan electrode for the addressing process, and in the third obtuse waveform pulse application the discharge is generated between an address electrode and a display electrode as well as between display electrodes in the previously lighted cell and in the previously unlighted cell in which a cathode is a display electrode that is also a scan electrode for the addressing process.

4. The method according to claim 1, wherein in the first obtuse waveform pulse application the discharge is generated between the display electrodes in the previously lighted cell and in the previously unlighted cell, in the second obtuse waveform pulse application the discharge is generated between the address electrode and the display electrode in the previously lighted cell, and in the third obtuse waveform pulse application the discharge is generated between the address electrode and the display electrode as well as between the display electrodes in the previously lighted cell and in the previously unlighted cell.

5. The method according to claim 4, wherein in the first obtuse waveform pulse application the discharge is generated between the display electrodes in the previously lighted cell and in the previously unlighted cell in which an anode is a display electrode that is also a scan electrode for the addressing process, and in the third obtuse waveform pulse application the discharge is generated between an address electrode and a display electrode as well as between display electrodes in the previously lighted cell and in the previously unlighted cell in which a cathode is a display electrode that is also a scan electrode for the addressing process.

6. A method for driving a three-electrode surface discharge AC type plasma display panel having an electrode matrix including an arrangement of display electrodes and an arrangement of address electrodes, the method comprising:

performing an initialization process for equalizing wall voltage in all cells that constitute a display screen to a preset value, an addressing process for controlling the wall voltage in each cell in accordance with display data and a sustaining process for generating display discharge only in cells to be lighted;

applying an obtuse waveform pulse three times to all cells as an operation of the initialization for simply increasing or decreasing potential of at least one electrode;

in the first obtuse waveform pulse application, generating discharge in a previously lighted cell that was lighted in the last sustaining before the initialization and in a previously unlighted cell that was not lighted in the last sustaining, so that the wall voltage in the previously lighted cell approaches an appropriate range and the wall voltage in the previously unlighted cell changes to a value within the appropriate range;

in the second obtuse waveform pulse application, generating discharge only in the previously lighted cell, so that the wall voltage thereof approaches the wall voltage in the previously unlighted cell; and in the third obtuse waveform pulse application, generating discharge in the previously lighted cell and in the previously unlighted cell, so that the wall voltages in these cells change to the preset value.

* * * * *